US007429968B2

(12) United States Patent
Aiba et al.

(10) Patent No.: US 7,429,968 B2
(45) Date of Patent: Sep. 30, 2008

(54) METHOD FOR DRIVING AN IMAGE DISPLAYING APPARATUS

(75) Inventors: Hideki Aiba, Moriya (JP); Yutaka Ochi, Yokohama (JP); Shigeo Shimizu, Yokohama (JP)

(73) Assignee: Victor Company of Japan Ltd., Yokohama (JP)

( * ) Notice: Subject to any disclaimer, the term of this patent is extended or adjusted under 35 U.S.C. 154(b) by 559 days.

(21) Appl. No.: 11/038,429

(22) Filed: Jan. 21, 2005

(65) Prior Publication Data

US 2005/0219234 A1 Oct. 6, 2005

(30) Foreign Application Priority Data

Feb. 2, 2004 (JP) ..... 2004-025122
Dec. 27, 2004 (JP) ..... 2004-378264

(51) Int. Cl.
*G09G 5/00* (2006.01)
*G09G 3/28* (2006.01)

(52) U.S. Cl. ..... 345/63

(58) Field of Classification Search ..... 345/204, 345/205, 690–692, 63
See application file for complete search history.

(56) References Cited

U.S. PATENT DOCUMENTS 6,025,818 A * 2/2000 Okano ..... 345/63
6,064,356 A * 5/2000 Shigeta ..... 345/63
6,088,012 A * 7/2000 Shigeta et al. ..... 345/63
6,091,398 A * 7/2000 Shigeta ..... 345/204
6,100,939 A * 8/2000 Kougami et al. ..... 348/687
6,369,782 B2 * 4/2002 Shigeta ..... 345/63
6,518,977 B1 * 2/2003 Naka et al. ..... 345/690
6,714,250 B1 * 3/2004 Correa et al. ..... 348/447
6,943,758 B2 * 9/2005 Holtslag et al. ..... 345/63
7,057,584 B2 * 6/2006 Jeong ..... 345/60
7,126,617 B2 * 10/2006 Yamamoto et al. ..... 345/690
7,227,581 B2 * 6/2007 Correa et al. ..... 348/447
2002/0097201 A1 * 7/2002 Yamamoto et al. ..... 345/60
2004/0212568 A1 * 10/2004 Yamada ..... 345/63

FOREIGN PATENT DOCUMENTS

JP 08-254965 10/1996
JP 2001-042818 2/2001

* cited by examiner

*Primary Examiner*—Amare Meengistu
*Assistant Examiner*—Elijah M Sheets
(74) *Attorney, Agent, or Firm*—Louis Woo

(57) ABSTRACT

The present invention provides a technique of a method for driving an image displaying apparatus to suppress animated picture pseudo-contour, flicker disturbance and pseudo-contour disturbance by making weighting of light emission within a field is made equal to or almost equal to each other at all gradations. According to this technique, when an image signal of multiple gradation is expressed by dividing one field duration into a plurality of subfields with different relative ratios of luminance, a given number of subfields among a plurality of subfields are divided into "2n" subfields (SF1*a* to SF8*b*) wherein "n" represents an arbitrary integral number. Then, "2n" subfield groups (SF1*a* to SF8*a*, SF1*b* to SF8*b*) are formed so that one group divided into "2n" subfield belong to the groups different from each other. Subfield groups (A and B) are symmetrically arranged with respect to the center of one field duration, and the subfields (SFna, SFnb) divided into "2n" subfields are symmetrically arranged.

3 Claims, 22 Drawing Sheets

FIG. 2

| | GROUP A | | | | | | | | GROUP B | | | | | | | |
|---|---|---|---|---|---|---|---|---|---|---|---|---|---|---|---|---|
| No. OF SF | SF8a | SF6a | SF4a | SF2a | SF1a | SF3a | SF5a | SF7a | SF7b | SF5b | SF3b | SF1b | SF2b | SF4b | SF6b | SF8b |
| WEIGHTING OF SF→ | 128/2 | 32/2 | 8/2 | 2/2 | 1/2 | 4/2 | 16/2 | 64/2 | 64/2 | 16/2 | 4/2 | 1/2 | 2/2 | 8/2 | 32/2 | 128/2 |
| GRADATION ↓ | | | | | | | | | | | | | | | | |
| 0 | | | | | | | | | | | | | | | | |
| 1 | | | | | O | | | | | | | O | | | | |
| 2 | | | | O | | | | | | | | | O | | | |
| 3 | | | | O | O | | | | | | | O | O | | | |
| 4 | | | | | | O | | | | | O | | | | | |
| 5 | | | | | O | O | | | | | O | O | | | | |
| 6 | | | | O | | O | | | | | O | | O | | | |
| 7 | | | | O | O | O | | | | | O | O | O | | | |
| 8 | | | O | | | | | | | | | | | O | | |
| 9 | | | O | | O | | | | | | | O | | O | | |
| 10 | | | O | O | | | | | | | | | O | O | | |
| 11 | | | O | O | O | | | | | | | O | O | O | | |
| 12 | | | O | | | O | | | | | O | | | O | | |
| 13 | | | O | | O | O | | | | | O | O | | O | | |
| 14 | | | O | O | | O | | | | | O | | O | O | | |
| 15 | | | O | O | O | O | | | | | O | O | O | O | | |
| 16 | | | | | | | O | | | O | | | | | | |
| 17 | | | | | O | | O | | | O | | O | | | | |
| 18 | | | | O | | | O | | | O | | | O | | | |
| 19 | | | | O | O | | O | | | O | | O | O | | | |
| 20 | | | | | | O | O | | | O | O | | | | | |
| 21 | | | | | O | O | O | | | O | O | O | | | | |
| 22 | | | | O | | O | O | | | O | O | | O | | | |
| 23 | | | | O | O | O | O | | | O | O | O | O | | | |
| 24 | | | O | | | | O | | | O | | | | O | | |
| 25 | | | O | | O | | O | | | O | | O | | O | | |
| 26 | | | O | O | | | O | | | O | | | O | O | | |
| 27 | | | O | O | O | | O | | | O | | O | O | O | | |
| 28 | | | O | | | O | O | | | O | O | | | O | | |
| 29 | | | O | | O | O | O | | | O | O | O | | O | | |
| 30 | | | O | O | | O | O | | | O | O | | O | O | | |
| 31 | | | O | O | O | O | O | | | O | O | O | O | O | | |
| 32 | | O | | | | | | | | | | | | | O | |
| 33 | | O | | | O | | | | | | | O | | | O | |
| 34 | | O | | O | | | | | | | | | O | | O | |
| 35 | | O | | O | O | | | | | | | O | O | | O | |
| 36 | | O | | | | O | | | | | O | | | | O | |
| 37 | | O | | | O | O | | | | | O | O | | | O | |
| 38 | | O | | O | | O | | | | | O | | O | | O | |
| 39 | | O | | O | O | O | | | | | O | O | O | | O | |
| 40 | | O | O | | | | | | | | | | | O | O | |
| 41 | | O | O | | O | | | | | | | O | | O | O | |
| 42 | | O | O | O | | | | | | | | | O | O | O | |
| 43 | | O | O | O | O | | | | | | | O | O | O | O | |

FIG. 3

| | GROUP A | | | | | | | | GROUP B | | | | | | | |
|---|---|---|---|---|---|---|---|---|---|---|---|---|---|---|---|---|
| No. OF SF | SF8a | SF6a | SF4a | SF2a | SF1a | SF3a | SF5a | SF7a | SF7b | SF5b | SF3b | SF1b | SF2b | SF4b | SF6b | SF8b |
| WEIGHTING OF SF→ | 128/2 | 32/2 | 8/2 | 2/2 | 1/2 | 4/2 | 16/2 | 64/2 | 64/2 | 16/2 | 4/2 | 1/2 | 2/2 | 8/2 | 32/2 | 128/2 |
| GRADATION↓ | | | | | | | | | | | | | | | | |
| 44 | | O | O | | | O | | | | | O | | | O | O | |
| 45 | | O | O | | O | O | | | | | O | O | | O | O | |
| 46 | | O | O | O | | O | | | | | O | | O | O | O | |
| 47 | | O | O | O | O | O | | | | | O | O | O | O | O | |
| 48 | | O | | | | | O | | | O | | | | | O | |
| 49 | | O | | | O | | O | | | O | | O | | | O | |
| 50 | | O | | O | | | O | | | O | | | O | | O | |
| 51 | | O | | O | O | | O | | | O | | O | O | | O | |
| 52 | | O | | | | O | O | | | O | O | | | | O | |
| 53 | | O | | | O | O | O | | | O | O | O | | | O | |
| 54 | | O | | O | | O | O | | | O | O | | O | | O | |
| 55 | | O | | O | O | O | O | | | O | O | O | O | | O | |
| 56 | | O | O | | | | O | | | O | | | | O | O | |
| 57 | | O | O | | O | | O | | | O | | O | | O | O | |
| 58 | | O | O | O | | | O | | | O | | | O | O | O | |
| 59 | | O | O | O | O | | O | | | O | | O | O | O | O | |
| 60 | | O | O | | | O | O | | | O | O | | | O | O | |
| 61 | | O | O | | O | O | O | | | O | O | O | | O | O | |
| 62 | | O | O | O | | O | O | | | O | O | | O | O | O | |
| 63 | | O | O | O | O | O | O | | | O | O | O | O | O | O | |
| 64 | | | | | | | | O | O | | | | | | | |
| 65 | | | | | O | | | O | O | | | O | | | | |
| 66 | | | | O | | | | O | O | | | | O | | | |
| 67 | | | | O | O | | | O | O | | | O | O | | | |
| 68 | | | | | | O | | O | O | | O | | | | | |
| 69 | | | | | O | O | | O | O | | O | O | | | | |
| 70 | | | | O | | O | | O | O | | O | | O | | | |
| 71 | | | | O | O | O | | O | O | | O | O | O | | | |
| 72 | | | O | | | | | O | O | | | | | O | | |
| 73 | | | O | | O | | | O | O | | | O | | O | | |
| 74 | | | O | O | | | | O | O | | | | O | O | | |
| 75 | | | O | O | O | | | O | O | | | O | O | O | | |
| 76 | | | O | | | O | | O | O | | O | | | O | | |
| 77 | | | O | | O | O | | O | O | | O | O | | O | | |
| 78 | | | O | O | | O | | O | O | | O | | O | O | | |
| 79 | | | O | O | O | O | | O | O | | O | O | O | O | | |
| 80 | | | | | | | O | O | O | O | | | | | | |
| 81 | | | | | O | | O | O | O | O | | O | | | | |
| 82 | | | | O | | | O | O | O | O | | | O | | | |
| 83 | | | | O | O | | O | O | O | O | | O | O | | | |
| 84 | | | | | | O | O | O | O | O | O | | | | | |
| 85 | | | | | O | O | O | O | O | O | O | O | | | | |
| 86 | | | | O | | O | O | O | O | O | O | | O | | | |
| 87 | | | | O | O | O | O | O | O | O | O | O | O | | | |

FIG. 4

| | GROUP A | | | | | | | | GROUP B | | | | | | | |
|---|---|---|---|---|---|---|---|---|---|---|---|---|---|---|---|---|
| No. OF SF | SF8a | SF6a | SF4a | SF2a | SF1a | SF3a | SF5a | SF7a | SF7b | SF5b | SF3b | SF1b | SF2b | SF4b | SF6b | SF8b |
| WEIGHTING OF SF→ | 128/2 | 32/2 | 8/2 | 2/2 | 1/2 | 4/2 | 16/2 | 64/2 | 64/2 | 16/2 | 4/2 | 1/2 | 2/2 | 8/2 | 32/2 | 128/2 |
| GRADATION ↓ | | | | | | | | | | | | | | | | |
| 88 | | | O | | | | O | O | O | O | | | | O | | |
| 89 | | | O | | O | | O | O | O | O | | O | | O | | |
| 90 | | | O | O | | | O | O | O | O | | | O | O | | |
| 91 | | | O | O | O | | O | O | O | O | | O | O | O | | |
| 92 | | | O | | | O | O | O | O | O | O | | | O | | |
| 93 | | | O | | O | O | O | O | O | O | O | O | | O | | |
| 94 | | | O | O | | O | O | O | O | O | O | | O | O | | |
| 95 | | | O | O | O | O | O | O | O | O | O | O | O | O | | |
| 96 | | O | | | | | | O | O | | | | | | O | |
| 97 | | O | | | O | | | O | O | | | O | | | O | |
| 98 | | O | | O | | | | O | O | | | | O | | O | |
| 99 | | O | | O | O | | | O | O | | | O | O | | O | |
| 100 | | O | | | | O | | O | O | | O | | | | O | |
| 101 | | O | | | O | O | | O | O | | O | O | | | O | |
| 102 | | O | | O | | O | | O | O | | O | | O | | O | |
| 103 | | O | | O | O | O | | O | O | | O | O | O | | O | |
| 104 | | O | O | | | | | O | O | | | | | O | O | |
| 105 | | O | O | | O | | | O | O | | | O | | O | O | |
| 106 | | O | O | O | | | | O | O | | | | O | O | O | |
| 107 | | O | O | O | O | | | O | O | | | O | O | O | O | |
| 108 | | O | O | | | O | | O | O | | O | | | O | O | |
| 109 | | O | O | | O | O | | O | O | | O | O | | O | O | |
| 110 | | O | O | O | | O | | O | O | | O | | O | O | O | |
| 111 | | O | O | O | O | O | | O | O | | O | O | O | O | O | |
| 112 | | O | | | | | O | O | O | O | | | | | O | |
| 113 | | O | | | O | | O | O | O | O | | O | | | O | |
| 114 | | O | | O | | | O | O | O | O | | | O | | O | |
| 115 | | O | | O | O | | O | O | O | O | | O | O | | O | |
| 116 | | O | | | | O | O | O | O | O | O | | | | O | |
| 117 | | O | | | O | O | O | O | O | O | O | O | | | O | |
| 118 | | O | | O | | O | O | O | O | O | O | | O | | O | |
| 119 | | O | | O | O | O | O | O | O | O | O | O | O | | O | |
| 120 | | O | O | | | | O | O | O | O | | | | O | O | |
| 121 | | O | O | | O | | O | O | O | O | | O | | O | O | |
| 122 | | O | O | O | | | O | O | O | O | | | O | O | O | |
| 123 | | O | O | O | O | | O | O | O | O | | O | O | O | O | |
| 124 | | O | O | | | O | O | O | O | O | O | | | O | O | |
| 125 | | O | O | | O | O | O | O | O | O | O | O | | O | O | |
| 126 | | O | O | O | | O | O | O | O | O | O | | O | O | O | |
| 127 | | O | O | O | O | O | O | O | O | O | O | O | O | O | O | |
| 128 | O | | | | | | | | | | | | | | | O |
| 129 | O | | | | O | | | | | | | O | | | | O |
| 130 | O | | | O | | | | | | | | | O | | | O |
| 131 | O | | | O | O | | | | | | | O | O | | | O |
| 132 | O | | | | | O | | | | | O | | | | | O |
| 133 | O | | | | O | O | | | | | O | O | | | | O |

FIG. 5

| | GROUP A | | | | | | | | GROUP B | | | | | | | |
|---|---|---|---|---|---|---|---|---|---|---|---|---|---|---|---|---|
| No. OF SF | SF8a | SF6a | SF4a | SF2a | SF1a | SF3a | SF5a | SF7a | SF7b | SF5b | SF3b | SF1b | SF2b | SF4b | SF6b | SF8b |
| WEIGHTING OF SF→ | 128/2 | 32/2 | 8/2 | 2/2 | 1/2 | 4/2 | 16/2 | 64/2 | 64/2 | 16/2 | 4/2 | 1/2 | 2/2 | 8/2 | 32/2 | 128/2 |
| GRADATION↓ | | | | | | | | | | | | | | | | |
| 134 | O | | | O | | O | | | | | O | | O | | | O |
| 135 | O | | | O | O | O | | | | | O | O | O | | | O |
| 136 | O | | O | | | | | | | | | | | O | | O |
| 137 | O | | O | | O | | | | | | | O | | O | | O |
| 138 | O | | O | O | | | | | | | | | O | O | | O |
| 139 | O | | O | O | O | | | | | | | O | O | O | | O |
| 140 | O | | O | | | O | | | | | O | | | O | | O |
| 141 | O | | O | | O | O | | | | | O | O | | O | | O |
| 142 | O | | O | O | | O | | | | | O | | O | O | | O |
| 143 | O | | O | O | O | O | | | | | O | O | O | O | | O |
| 144 | O | | | | | | O | | | O | | | | | | O |
| 145 | O | | | | O | | O | | | O | | O | | | | O |
| 146 | O | | | O | | | O | | | O | | | O | | | O |
| 147 | O | | | O | O | | O | | | O | | O | O | | | O |
| 148 | O | | | | | O | O | | | O | O | | | | | O |
| 149 | O | | | | O | O | O | | | O | O | O | | | | O |
| 150 | O | | | O | | O | O | | | O | O | | O | | | O |
| 151 | O | | | O | O | O | O | | | O | O | O | O | | | O |
| 152 | O | | O | | | | O | | | O | | | | O | | O |
| 153 | O | | O | | O | | O | | | O | | O | | O | | O |
| 154 | O | | O | O | | | O | | | O | | | O | O | | O |
| 155 | O | | O | O | O | | O | | | O | | O | O | O | | O |
| 156 | O | | O | | | O | O | | | O | O | | | O | | O |
| 157 | O | | O | | O | O | O | | | O | O | O | | O | | O |
| 158 | O | | O | O | | O | O | | | O | O | | O | O | | O |
| 159 | O | | O | O | O | O | O | | | O | O | O | O | O | | O |
| 160 | O | O | | | | | | | | | | | | | O | O |
| 161 | O | O | | | O | | | | | | | O | | | O | O |
| 162 | O | O | | O | | | | | | | | | O | | O | O |
| 163 | O | O | | O | O | | | | | | | O | O | | O | O |
| 164 | O | O | | | | O | | | | | O | | | | O | O |
| 165 | O | O | | | O | O | | | | | O | O | | | O | O |
| 166 | O | O | | O | | O | | | | | O | | O | | O | O |
| 167 | O | O | | O | O | O | | | | | O | O | O | | O | O |
| 168 | O | O | O | | | | | | | | | | | O | O | O |
| 169 | O | O | O | | O | | | | | | | O | | O | O | O |
| 170 | O | O | O | O | | | | | | | | | O | O | O | O |
| 171 | O | O | O | O | O | | | | | | | O | O | O | O | O |
| 172 | O | O | O | | | O | | | | | O | | | O | O | O |
| 173 | O | O | O | | O | O | | | | | O | O | | O | O | O |
| 174 | O | O | O | O | | O | | | | | O | | O | O | O | O |
| 175 | O | O | O | O | O | O | | | | | O | O | O | O | O | O |
| 176 | O | O | | | | | O | | | O | | | | | O | O |
| 177 | O | O | | | O | | O | | | O | | O | | | O | O |
| 178 | O | O | | O | | | O | | | O | | | O | | O | O |
| 179 | O | O | | O | O | | O | | | O | | O | O | | O | O |

FIG. 6

| | GROUP A | | | | | | | | GROUP B | | | | | | | |
|---|---|---|---|---|---|---|---|---|---|---|---|---|---|---|---|---|
| No. OF SF | SF8a | SF6a | SF4a | SF2a | SF1a | SF3a | SF5a | SF7a | SF7b | SF5b | SF3b | SF1b | SF2b | SF4b | SF6b | SF8b |
| WEIGHTING OF SF→ | 128/2 | 32/2 | 8/2 | 2/2 | 1/2 | 4/2 | 16/2 | 64/2 | 64/2 | 16/2 | 4/2 | 1/2 | 2/2 | 8/2 | 32/2 | 128/2 |
| GRADATION↓ | | | | | | | | | | | | | | | | |
| 180 | O | O | | | | O | O | | | O | O | | | | O | O |
| 181 | O | O | | | O | O | O | | | O | O | O | | | O | O |
| 182 | O | O | | O | | O | O | | | O | O | | O | | O | O |
| 183 | O | O | | O | O | O | O | | | O | O | O | O | | O | O |
| 184 | O | O | O | | | | O | | | O | | | | O | O | O |
| 185 | O | O | O | | O | | O | | | O | | O | | O | O | O |
| 186 | O | O | O | O | | | O | | | O | | | O | O | O | O |
| 187 | O | O | O | O | O | | O | | | O | | O | O | O | O | O |
| 188 | O | O | O | | | O | O | | | O | O | | | O | O | O |
| 189 | O | O | O | | O | O | O | | | O | O | O | | O | O | O |
| 190 | O | O | O | O | | O | O | | | O | O | | O | O | O | O |
| 191 | O | O | O | O | O | O | O | | | O | O | O | O | O | O | O |
| 192 | O | | | | | | | O | O | | | | | | | O |
| 193 | O | | | | O | | | O | O | | | O | | | | O |
| 194 | O | | | O | | | | O | O | | | | O | | | O |
| 195 | O | | | O | O | | | O | O | | | O | O | | | O |
| 196 | O | | | | | O | | O | O | | O | | | | | O |
| 197 | O | | | | O | O | | O | O | | O | O | | | | O |
| 198 | O | | | O | | O | | O | O | | O | | O | | | O |
| 199 | O | | | O | O | O | | O | O | | O | O | O | | | O |
| 200 | O | | O | | | | | O | O | | | | | O | | O |
| 201 | O | | O | | O | | | O | O | | | O | | O | | O |
| 202 | O | | O | O | | | | O | O | | | | O | O | | O |
| 203 | O | | O | O | O | | | O | O | | | O | O | O | | O |
| 204 | O | | O | | | O | | O | O | | O | | | O | | O |
| 205 | O | | O | | O | O | | O | O | | O | O | | O | | O |
| 206 | O | | O | O | | O | | O | O | | O | | O | O | | O |
| 207 | O | | O | O | O | O | | O | O | | O | O | O | O | | O |
| 208 | O | | | | | | O | O | O | O | | | | | | O |
| 209 | O | | | | O | | O | O | O | O | | O | | | | O |
| 210 | O | | | O | | | O | O | O | O | | | O | | | O |
| 211 | O | | | O | O | | O | O | O | O | | O | O | | | O |
| 212 | O | | | | | O | O | O | O | O | O | | | | | O |
| 213 | O | | | | O | O | O | O | O | O | O | O | | | | O |
| 214 | O | | | O | | O | O | O | O | O | O | | O | | | O |
| 215 | O | | | O | O | O | O | O | O | O | O | O | O | | | O |
| 216 | O | | O | | | | O | O | O | O | | | | O | | O |
| 217 | O | | O | | O | | O | O | O | O | | O | | O | | O |
| 218 | O | | O | O | | | O | O | O | O | | | O | O | | O |
| 219 | O | | O | O | O | | O | O | O | O | | O | O | O | | O |
| 220 | O | | O | | | O | O | O | O | O | O | | | O | | O |
| 221 | O | | O | | O | O | O | O | O | O | O | O | | O | | O |
| 222 | O | | O | O | | O | O | O | O | O | O | | O | O | | O |
| 223 | O | | O | O | O | O | O | O | O | O | O | O | O | O | | O |

FIG. 7

| | GROUP A | | | | | | | | GROUP B | | | | | | | |
|---|---|---|---|---|---|---|---|---|---|---|---|---|---|---|---|---|
| No. OF SF | SF8a | SF6a | SF4a | SF2a | SF1a | SF3a | SF5a | SF7a | SF7b | SF5b | SF3b | SF1b | SF2b | SF4b | SF6b | SF8b |
| WEIGHTING OF SF→ | 128/2 | 32/2 | 8/2 | 2/2 | 1/2 | 4/2 | 16/2 | 64/2 | 64/2 | 16/2 | 4/2 | 1/2 | 2/2 | 8/2 | 32/2 | 128/2 |
| GRADATION↓ | | | | | | | | | | | | | | | | |
| 224 | O | O | | | | | | O | O | | | | | | O | O |
| 225 | O | O | | | O | | | O | O | | | O | | | O | O |
| 226 | O | O | | O | | | | O | O | | | | O | | O | O |
| 227 | O | O | | O | O | | | O | O | | | O | O | | O | O |
| 228 | O | O | | | | O | | O | O | | O | | | | O | O |
| 229 | O | O | | | O | O | | O | O | | O | O | | | O | O |
| 230 | O | O | | O | | O | | O | O | | O | | O | | O | O |
| 231 | O | O | | O | O | O | | O | O | | O | O | O | | O | O |
| 232 | O | O | O | | | | | O | O | | | | | O | O | O |
| 233 | O | O | O | | O | | | O | O | | | O | | O | O | O |
| 234 | O | O | O | O | | | | O | O | | | | O | O | O | O |
| 235 | O | O | O | O | O | | | O | O | | | O | O | O | O | O |
| 236 | O | O | O | | | O | | O | O | | O | | | O | O | O |
| 237 | O | O | O | | O | O | | O | O | | O | O | | O | O | O |
| 238 | O | O | O | O | | O | | O | O | | O | | O | O | O | O |
| 239 | O | O | O | O | O | O | | O | O | | O | O | O | O | O | O |
| 240 | O | O | | | | | O | O | O | O | | | | | O | O |
| 241 | O | O | | | O | | O | O | O | O | | O | | | O | O |
| 242 | O | O | | O | | | O | O | O | O | | | O | | O | O |
| 243 | O | O | | O | O | | O | O | O | O | | O | O | | O | O |
| 244 | O | O | | | | O | O | O | O | O | O | | | | O | O |
| 245 | O | O | | | O | O | O | O | O | O | O | O | | | O | O |
| 246 | O | O | | O | | O | O | O | O | O | O | | O | | O | O |
| 247 | O | O | | O | O | O | O | O | O | O | O | O | O | | O | O |
| 248 | O | O | O | | | | O | O | O | O | | | | O | O | O |
| 249 | O | O | O | | O | | O | O | O | O | | O | | O | O | O |
| 250 | O | O | O | O | | | O | O | O | O | | | O | O | O | O |
| 251 | O | O | O | O | O | | O | O | O | O | | O | O | O | O | O |
| 252 | O | O | O | | | O | O | O | O | O | O | | | O | O | O |
| 253 | O | O | O | | O | O | O | O | O | O | O | O | | O | O | O |
| 254 | O | O | O | O | | O | O | O | O | O | O | | O | O | O | O |
| 255 | O | O | O | O | O | O | O | O | O | O | O | O | O | O | O | O |

FIG. 9

| | GROUP A | | | | | | | | | | | | GROUP B | | | | | | | | | | | |
|---|---|---|---|---|---|---|---|---|---|---|---|---|---|---|---|---|---|---|---|---|---|---|---|---|
| No. OF SF | SF12a | SF10a | SF8a | SF6a | SF4a | SF2a | SF1a | SF3a | SF5a | SF7a | SF9a | SF11a | SF11b | SF9b | SF7b | SF5b | SF3b | SF1b | SF2b | SF4b | SF6b | SF8b | SF10b | SF12b |
| WEIGHTING OF SF→ | 32/2 | 32/2 | 32/2 | 32/2 | 8/2 | 2/2 | 1/2 | 4/2 | 16/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 |
| GRADATION ↓ | | | | | | | | | | | | | | | | | | | | | | | | |
| 0 | | | | | | | | | | | | | | | | | | | | | | | | |
| 1 | | | | | | | ○ | | | | | | | | | | | ○ | | | | | | |
| 2 | | | | | | ○ | | | | | | | | | | | | | ○ | | | | | |
| 3 | | | | | | ○ | ○ | | | | | | | | | | | ○ | ○ | | | | | |
| 4 | | | | | | | | ○ | | | | | | | | | ○ | | | | | | | |
| 5 | | | | | | | ○ | ○ | | | | | | | | | ○ | ○ | | | | | | |
| 6 | | | | | | ○ | | ○ | | | | | | | | | ○ | | ○ | | | | | |
| 7 | | | | | | ○ | ○ | ○ | | | | | | | | | ○ | ○ | ○ | | | | | |
| 8 | | | | | ○ | | | | | | | | | | | | | | | ○ | | | | |
| 9 | | | | | ○ | | ○ | | | | | | | | | | | ○ | | ○ | | | | |
| 10 | | | | | ○ | ○ | | | | | | | | | | | | | ○ | ○ | | | | |
| 11 | | | | | ○ | ○ | ○ | | | | | | | | | | | ○ | ○ | ○ | | | | |
| 12 | | | | | ○ | | | ○ | | | | | | | | | ○ | | | ○ | | | | |
| 13 | | | | | ○ | | ○ | ○ | | | | | | | | | ○ | ○ | | ○ | | | | |
| 14 | | | | | ○ | ○ | | ○ | | | | | | | | | ○ | | ○ | ○ | | | | |
| 15 | | | | | ○ | ○ | ○ | ○ | | | | | | | | | ○ | ○ | ○ | ○ | | | | |
| 16 | | | | | | | | | ○ | | | | | | | ○ | | | | | | | | |
| 17 | | | | | | | ○ | | ○ | | | | | | | ○ | | ○ | | | | | | |
| 18 | | | | | | ○ | | | ○ | | | | | | | ○ | | | ○ | | | | | |
| 19 | | | | | | ○ | ○ | | ○ | | | | | | | ○ | | ○ | ○ | | | | | |
| 20 | | | | | | | | ○ | ○ | | | | | | | ○ | ○ | | | | | | | |
| 21 | | | | | | | ○ | ○ | ○ | | | | | | | ○ | ○ | ○ | | | | | | |
| 22 | | | | | | ○ | | ○ | ○ | | | | | | | ○ | ○ | | ○ | | | | | |
| 23 | | | | | | ○ | ○ | ○ | ○ | | | | | | | ○ | ○ | ○ | ○ | | | | | |
| 24 | | | | | ○ | | | | ○ | | | | | | | ○ | | | | ○ | | | | |
| 25 | | | | | ○ | | ○ | | ○ | | | | | | | ○ | | ○ | | ○ | | | | |
| 26 | | | | | ○ | ○ | | | ○ | | | | | | | ○ | | | ○ | ○ | | | | |
| 27 | | | | | ○ | ○ | ○ | | ○ | | | | | | | ○ | | ○ | ○ | ○ | | | | |
| 28 | | | | | ○ | | | ○ | ○ | | | | | | | ○ | ○ | | | ○ | | | | |
| 29 | | | | | ○ | | ○ | ○ | ○ | | | | | | | ○ | ○ | ○ | | ○ | | | | |
| 30 | | | | | ○ | ○ | | ○ | ○ | | | | | | | ○ | ○ | | ○ | ○ | | | | |
| 31 | | | | | ○ | ○ | ○ | ○ | ○ | | | | | | | ○ | ○ | ○ | ○ | ○ | | | | |
| 32 | | | | ○ | | | | | | | | | | | | | | | | | ○ | | | |
| 33 | | | | ○ | | | ○ | | | | | | | | | | | ○ | | | ○ | | | |
| 34 | | | | ○ | | ○ | | | | | | | | | | | | | ○ | | ○ | | | |
| 35 | | | | ○ | | ○ | ○ | | | | | | | | | | | ○ | ○ | | ○ | | | |
| 36 | | | | ○ | | | | ○ | | | | | | | | | ○ | | | | ○ | | | |
| 37 | | | | ○ | | | ○ | ○ | | | | | | | | | ○ | ○ | | | ○ | | | |
| 38 | | | | ○ | | ○ | | ○ | | | | | | | | | ○ | | ○ | | ○ | | | |
| 39 | | | | ○ | | ○ | ○ | ○ | | | | | | | | | ○ | ○ | ○ | | ○ | | | |
| 40 | | | | ○ | ○ | | | | | | | | | | | | | | | ○ | ○ | | | |
| 41 | | | | ○ | ○ | | ○ | | | | | | | | | | | ○ | | ○ | ○ | | | |
| 42 | | | | ○ | ○ | ○ | | | | | | | | | | | | | ○ | ○ | ○ | | | |
| 43 | | | | ○ | ○ | ○ | ○ | | | | | | | | | | | ○ | ○ | ○ | ○ | | | |
| 44 | | | | ○ | ○ | | | ○ | | | | | | | | | ○ | | | ○ | ○ | | | |
| 45 | | | | ○ | ○ | | ○ | ○ | | | | | | | | | ○ | ○ | | ○ | ○ | | | |
| 46 | | | | ○ | ○ | ○ | | ○ | | | | | | | | | ○ | | ○ | ○ | ○ | | | |
| 47 | | | | ○ | ○ | ○ | ○ | ○ | | | | | | | | | ○ | ○ | ○ | ○ | ○ | | | |
| 48 | | | | ○ | | | | | ○ | | | | | | | ○ | | | | | ○ | | | |
| 49 | | | | ○ | | | ○ | | ○ | | | | | | | ○ | | ○ | | | ○ | | | |
| 50 | | | | ○ | | ○ | | | ○ | | | | | | | ○ | | | ○ | | ○ | | | |
| 51 | | | | ○ | | ○ | ○ | | ○ | | | | | | | ○ | | ○ | ○ | | ○ | | | |
| 52 | | | | ○ | | | | ○ | ○ | | | | | | | ○ | ○ | | | | ○ | | | |
| 53 | | | | ○ | | | ○ | ○ | ○ | | | | | | | ○ | ○ | ○ | | | ○ | | | |
| 54 | | | | ○ | | ○ | | ○ | ○ | | | | | | | ○ | ○ | | ○ | | ○ | | | |
| 55 | | | | ○ | | ○ | ○ | ○ | ○ | | | | | | | ○ | ○ | ○ | ○ | | ○ | | | |
| 56 | | | | ○ | ○ | | | | ○ | | | | | | | ○ | | | | ○ | ○ | | | |
| 57 | | | | ○ | ○ | | ○ | | ○ | | | | | | | ○ | | ○ | | ○ | ○ | | | |
| 58 | | | | ○ | ○ | ○ | | | ○ | | | | | | | ○ | | | ○ | ○ | ○ | | | |
| 59 | | | | ○ | ○ | ○ | ○ | | ○ | | | | | | | ○ | | ○ | ○ | ○ | ○ | | | |
| 60 | | | | ○ | ○ | | | ○ | ○ | | | | | | | ○ | ○ | | | ○ | ○ | | | |

FIG. 10

| | GROUP A | | | | | | | | | | | | GROUP B | | | | | | | | | | | |
|---|---|---|---|---|---|---|---|---|---|---|---|---|---|---|---|---|---|---|---|---|---|---|---|---|
| No. OF SF | SF12a | SF10a | SF8a | SF6a | SF4a | SF2a | SF1a | SF3a | SF5a | SF7a | SF9a | SF11a | SF11b | SF9b | SF7b | SF5b | SF3b | SF1b | SF2b | SF4b | SF6b | SF8b | SF10b | SF12b |
| WEIGHTING OF SF→ | 32/2 | 32/2 | 32/2 | 32/2 | 8/2 | 2/2 | 1/2 | 4/2 | 16/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 |
| GRADATION ↓ | | | | | | | | | | | | | | | | | | | | | | | | |
| 61 | | | | ○ | ○ | | ○ | ○ | ○ | | | | | | | ○ | ○ | ○ | | ○ | ○ | | | |
| 62 | | | | ○ | ○ | ○ | | ○ | ○ | | | | | | | ○ | ○ | | ○ | ○ | ○ | | | |
| 63 | | | | ○ | ○ | ○ | ○ | ○ | ○ | | | | | | | ○ | ○ | ○ | ○ | ○ | ○ | | | |
| 64 | | | | ○ | | | | | | ○ | | | | | ○ | | | | | | ○ | | | |
| 65 | | | | ○ | | | ○ | | | ○ | | | | | ○ | | | ○ | | | ○ | | | |
| 66 | | | | ○ | | ○ | | | | ○ | | | | | ○ | | | | ○ | | ○ | | | |
| 67 | | | | ○ | | ○ | ○ | | | ○ | | | | | ○ | | | ○ | ○ | | ○ | | | |
| 68 | | | | ○ | | | | ○ | | ○ | | | | | ○ | | ○ | | | | ○ | | | |
| 69 | | | | ○ | | | ○ | ○ | | ○ | | | | | ○ | | ○ | ○ | | | ○ | | | |
| 70 | | | | ○ | | ○ | | ○ | | ○ | | | | | ○ | | ○ | | ○ | | ○ | | | |
| 71 | | | | ○ | | ○ | ○ | ○ | | ○ | | | | | ○ | | ○ | ○ | ○ | | ○ | | | |
| 72 | | | | ○ | ○ | | | | | ○ | | | | | ○ | | | | | ○ | ○ | | | |
| 73 | | | | ○ | ○ | | ○ | | | ○ | | | | | ○ | | | ○ | | ○ | ○ | | | |
| 74 | | | | ○ | ○ | ○ | | | | ○ | | | | | ○ | | | | ○ | ○ | ○ | | | |
| 75 | | | | ○ | ○ | ○ | ○ | | | ○ | | | | | ○ | | | ○ | ○ | ○ | ○ | | | |
| 76 | | | | ○ | ○ | | | ○ | | ○ | | | | | ○ | | ○ | | | ○ | ○ | | | |
| 77 | | | | ○ | ○ | | ○ | ○ | | ○ | | | | | ○ | | ○ | ○ | | ○ | ○ | | | |
| 78 | | | | ○ | ○ | ○ | | ○ | | ○ | | | | | ○ | | ○ | | ○ | ○ | ○ | | | |
| 79 | | | | ○ | ○ | ○ | ○ | ○ | | ○ | | | | | ○ | | ○ | ○ | ○ | ○ | ○ | | | |
| 80 | | | | ○ | | | | | ○ | ○ | | | | | ○ | ○ | | | | | ○ | | | |
| 81 | | | | ○ | | | ○ | | ○ | ○ | | | | | ○ | ○ | | ○ | | | ○ | | | |
| 82 | | | | ○ | | ○ | | | ○ | ○ | | | | | ○ | ○ | | | ○ | | ○ | | | |
| 83 | | | | ○ | | ○ | ○ | | ○ | ○ | | | | | ○ | ○ | | ○ | ○ | | ○ | | | |
| 84 | | | | ○ | | | | ○ | ○ | ○ | | | | | ○ | ○ | ○ | | | | ○ | | | |
| 85 | | | | ○ | | | ○ | ○ | ○ | ○ | | | | | ○ | ○ | ○ | ○ | | | ○ | | | |
| 86 | | | | ○ | | ○ | | ○ | ○ | ○ | | | | | ○ | ○ | ○ | | ○ | | ○ | | | |
| 87 | | | | ○ | | ○ | ○ | ○ | ○ | ○ | | | | | ○ | ○ | ○ | ○ | ○ | | ○ | | | |
| 88 | | | | ○ | ○ | | | | ○ | ○ | | | | | ○ | ○ | | | | ○ | ○ | | | |
| 89 | | | | ○ | ○ | | ○ | | ○ | ○ | | | | | ○ | ○ | | ○ | | ○ | ○ | | | |
| 90 | | | | ○ | ○ | ○ | | | ○ | ○ | | | | | ○ | ○ | | | ○ | ○ | ○ | | | |
| 91 | | | | ○ | ○ | ○ | ○ | | ○ | ○ | | | | | ○ | ○ | | ○ | ○ | ○ | ○ | | | |
| 92 | | | | ○ | ○ | | | ○ | ○ | ○ | | | | | ○ | ○ | ○ | | | ○ | ○ | | | |
| 93 | | | | ○ | ○ | | ○ | ○ | ○ | ○ | | | | | ○ | ○ | ○ | ○ | | ○ | ○ | | | |
| 94 | | | | ○ | ○ | ○ | | ○ | ○ | ○ | | | | | ○ | ○ | ○ | | ○ | ○ | ○ | | | |
| 95 | | | | ○ | ○ | ○ | ○ | ○ | ○ | ○ | | | | | ○ | ○ | ○ | ○ | ○ | ○ | ○ | | | |
| 96 | | | ○ | ○ | | | | | | ○ | | | | | ○ | | | | | | ○ | ○ | | |
| 97 | | | ○ | ○ | | | ○ | | | ○ | | | | | ○ | | | ○ | | | ○ | ○ | | |
| 98 | | | ○ | ○ | | ○ | | | | ○ | | | | | ○ | | | | ○ | | ○ | ○ | | |
| 99 | | | ○ | ○ | | ○ | ○ | | | ○ | | | | | ○ | | | ○ | ○ | | ○ | ○ | | |
| 100 | | | ○ | ○ | | | | ○ | | ○ | | | | | ○ | | ○ | | | | ○ | ○ | | |
| 101 | | | ○ | ○ | | | ○ | ○ | | ○ | | | | | ○ | | ○ | ○ | | | ○ | ○ | | |
| 102 | | | ○ | ○ | | ○ | | ○ | | ○ | | | | | ○ | | ○ | | ○ | | ○ | ○ | | |
| 103 | | | ○ | ○ | | ○ | ○ | ○ | | ○ | | | | | ○ | | ○ | ○ | ○ | | ○ | ○ | | |
| 104 | | | ○ | ○ | ○ | | | | | ○ | | | | | ○ | | | | | ○ | ○ | ○ | | |
| 105 | | | ○ | ○ | ○ | | ○ | | | ○ | | | | | ○ | | | ○ | | ○ | ○ | ○ | | |
| 106 | | | ○ | ○ | ○ | ○ | | | | ○ | | | | | ○ | | | | ○ | ○ | ○ | ○ | | |
| 107 | | | ○ | ○ | ○ | ○ | ○ | | | ○ | | | | | ○ | | | ○ | ○ | ○ | ○ | ○ | | |
| 108 | | | ○ | ○ | ○ | | | ○ | | ○ | | | | | ○ | | ○ | | | ○ | ○ | ○ | | |
| 109 | | | ○ | ○ | ○ | | ○ | ○ | | ○ | | | | | ○ | | ○ | ○ | | ○ | ○ | ○ | | |
| 110 | | | ○ | ○ | ○ | ○ | | ○ | | ○ | | | | | ○ | | ○ | | ○ | ○ | ○ | ○ | | |
| 111 | | | ○ | ○ | ○ | ○ | ○ | ○ | | ○ | | | | | ○ | | ○ | ○ | ○ | ○ | ○ | ○ | | |
| 112 | | | ○ | ○ | | | | | ○ | ○ | | | | | ○ | ○ | | | | | ○ | ○ | | |
| 113 | | | ○ | ○ | | | ○ | | ○ | ○ | | | | | ○ | ○ | | ○ | | | ○ | ○ | | |
| 114 | | | ○ | ○ | | ○ | | | ○ | ○ | | | | | ○ | ○ | | | ○ | | ○ | ○ | | |
| 115 | | | ○ | ○ | | ○ | ○ | | ○ | ○ | | | | | ○ | ○ | | ○ | ○ | | ○ | ○ | | |
| 116 | | | ○ | ○ | | | | ○ | ○ | ○ | | | | | ○ | ○ | ○ | | | | ○ | ○ | | |
| 117 | | | ○ | ○ | | | ○ | ○ | ○ | ○ | | | | | ○ | ○ | ○ | ○ | | | ○ | ○ | | |
| 118 | | | ○ | ○ | | ○ | | ○ | ○ | ○ | | | | | ○ | ○ | ○ | | ○ | | ○ | ○ | | |
| 119 | | | ○ | ○ | | ○ | ○ | ○ | ○ | ○ | | | | | ○ | ○ | ○ | ○ | ○ | | ○ | ○ | | |
| 120 | | | ○ | ○ | ○ | | | | ○ | ○ | | | | | ○ | ○ | | | | ○ | ○ | ○ | | |
| 121 | | | ○ | ○ | ○ | | ○ | | ○ | ○ | | | | | ○ | ○ | | ○ | | ○ | ○ | ○ | | |
| 122 | | | ○ | ○ | ○ | ○ | | | ○ | ○ | | | | | ○ | ○ | | | ○ | ○ | ○ | ○ | | |
| 123 | | | ○ | ○ | ○ | ○ | ○ | | ○ | ○ | | | | | ○ | ○ | | ○ | ○ | ○ | ○ | ○ | | |
| 124 | | | ○ | ○ | ○ | | | ○ | ○ | ○ | | | | | ○ | ○ | ○ | | | ○ | ○ | ○ | | |
| 125 | | | ○ | ○ | ○ | | ○ | ○ | ○ | ○ | | | | | ○ | ○ | ○ | ○ | | ○ | ○ | ○ | | |

FIG. 11

| | GROUP A | | | | | | | | | | | | GROUP B | | | | | | | | | | | |
|---|---|---|---|---|---|---|---|---|---|---|---|---|---|---|---|---|---|---|---|---|---|---|---|---|
| No. OF SF | SF12a | SF10a | SF8a | SF6a | SF4a | SF2a | SF1a | SF3a | SF5a | SF7a | SF9a | SF11a | SF11b | SF9b | SF7b | SF5b | SF3b | SF1b | SF2b | SF4b | SF6b | SF8b | SF10b | SF12b |
| WEIGHTING OF SF→ | 32/2 | 32/2 | 32/2 | 32/2 | 8/2 | 2/2 | 1/2 | 4/2 | 16/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 |
| GRADATION ↓ | | | | | | | | | | | | | | | | | | | | | | | | |
| 126 | | | ○ | ○ | ○ | ○ | | ○ | ○ | ○ | | | | | ○ | ○ | ○ | | ○ | ○ | ○ | ○ | | |
| 127 | | | ○ | ○ | ○ | ○ | ○ | ○ | ○ | ○ | | | | | ○ | ○ | ○ | ○ | ○ | ○ | ○ | ○ | | |
| 128 | | | ○ | ○ | | | | | | ○ | ○ | | | ○ | ○ | | | | | | ○ | ○ | | |
| 129 | | | ○ | ○ | | | ○ | | | ○ | ○ | | | ○ | ○ | | | ○ | | | ○ | ○ | | |
| 130 | | | ○ | ○ | | ○ | | | | ○ | ○ | | | ○ | ○ | | | | ○ | | ○ | ○ | | |
| 131 | | | ○ | ○ | | ○ | ○ | | | ○ | ○ | | | ○ | ○ | | | ○ | ○ | | ○ | ○ | | |
| 132 | | | ○ | ○ | | | | ○ | | ○ | ○ | | | ○ | ○ | | ○ | | | | ○ | ○ | | |
| 133 | | | ○ | ○ | | | ○ | ○ | | ○ | ○ | | | ○ | ○ | | ○ | ○ | | | ○ | ○ | | |
| 134 | | | ○ | ○ | | ○ | | ○ | | ○ | ○ | | | ○ | ○ | | ○ | | ○ | | ○ | ○ | | |
| 135 | | | ○ | ○ | | ○ | ○ | ○ | | ○ | ○ | | | ○ | ○ | | ○ | ○ | ○ | | ○ | ○ | | |
| 136 | | | ○ | ○ | ○ | | | | | ○ | ○ | | | ○ | ○ | | | | | ○ | ○ | ○ | | |
| 137 | | | ○ | ○ | ○ | | ○ | | | ○ | ○ | | | ○ | ○ | | | ○ | | ○ | ○ | ○ | | |
| 138 | | | ○ | ○ | ○ | ○ | | | | ○ | ○ | | | ○ | ○ | | | | ○ | ○ | ○ | ○ | | |
| 139 | | | ○ | ○ | ○ | ○ | ○ | | | ○ | ○ | | | ○ | ○ | | | ○ | ○ | ○ | ○ | ○ | | |
| 140 | | | ○ | ○ | ○ | | | ○ | | ○ | ○ | | | ○ | ○ | | ○ | | | ○ | ○ | ○ | | |
| 141 | | | ○ | ○ | ○ | | ○ | ○ | | ○ | ○ | | | ○ | ○ | | ○ | ○ | | ○ | ○ | ○ | | |
| 142 | | | ○ | ○ | ○ | ○ | | ○ | | ○ | ○ | | | ○ | ○ | | ○ | | ○ | ○ | ○ | ○ | | |
| 143 | | | ○ | ○ | ○ | ○ | ○ | ○ | | ○ | ○ | | | ○ | ○ | | ○ | ○ | ○ | ○ | ○ | ○ | | |
| 144 | | | ○ | ○ | | | | | ○ | ○ | ○ | | | ○ | ○ | ○ | | | | | ○ | ○ | | |
| 145 | | | ○ | ○ | | | ○ | | ○ | ○ | ○ | | | ○ | ○ | ○ | | ○ | | | ○ | ○ | | |
| 146 | | | ○ | ○ | | ○ | | | ○ | ○ | ○ | | | ○ | ○ | ○ | | | ○ | | ○ | ○ | | |
| 147 | | | ○ | ○ | | ○ | ○ | | ○ | ○ | ○ | | | ○ | ○ | ○ | | ○ | ○ | | ○ | ○ | | |
| 148 | | | ○ | ○ | | | | ○ | ○ | ○ | ○ | | | ○ | ○ | ○ | ○ | | | | ○ | ○ | | |
| 149 | | | ○ | ○ | | | ○ | ○ | ○ | ○ | ○ | | | ○ | ○ | ○ | ○ | ○ | | | ○ | ○ | | |
| 150 | | | ○ | ○ | | ○ | | ○ | ○ | ○ | ○ | | | ○ | ○ | ○ | ○ | | ○ | | ○ | ○ | | |
| 151 | | | ○ | ○ | | ○ | ○ | ○ | ○ | ○ | ○ | | | ○ | ○ | ○ | ○ | ○ | ○ | | ○ | ○ | | |
| 152 | | | ○ | ○ | ○ | | | | ○ | ○ | ○ | | | ○ | ○ | ○ | | | | ○ | ○ | ○ | | |
| 153 | | | ○ | ○ | ○ | | ○ | | ○ | ○ | ○ | | | ○ | ○ | ○ | | ○ | | ○ | ○ | ○ | | |
| 154 | | | ○ | ○ | ○ | ○ | | | ○ | ○ | ○ | | | ○ | ○ | ○ | | | ○ | ○ | ○ | ○ | | |
| 155 | | | ○ | ○ | ○ | ○ | ○ | | ○ | ○ | ○ | | | ○ | ○ | ○ | | ○ | ○ | ○ | ○ | ○ | | |
| 156 | | | ○ | ○ | ○ | | | ○ | ○ | ○ | ○ | | | ○ | ○ | ○ | ○ | | | ○ | ○ | ○ | | |
| 157 | | | ○ | ○ | ○ | | ○ | ○ | ○ | ○ | ○ | | | ○ | ○ | ○ | ○ | ○ | | ○ | ○ | ○ | | |
| 158 | | | ○ | ○ | ○ | ○ | | ○ | ○ | ○ | ○ | | | ○ | ○ | ○ | ○ | | ○ | ○ | ○ | ○ | | |
| 159 | | | ○ | ○ | ○ | ○ | ○ | ○ | ○ | ○ | ○ | | | ○ | ○ | ○ | ○ | ○ | ○ | ○ | ○ | ○ | | |
| 160 | | ○ | ○ | ○ | | | | | | ○ | ○ | | | ○ | ○ | | | | | | ○ | ○ | ○ | |
| 161 | | ○ | ○ | ○ | | | ○ | | | ○ | ○ | | | ○ | ○ | | | ○ | | | ○ | ○ | ○ | |
| 162 | | ○ | ○ | ○ | | ○ | | | | ○ | ○ | | | ○ | ○ | | | | ○ | | ○ | ○ | ○ | |
| 163 | | ○ | ○ | ○ | | ○ | ○ | | | ○ | ○ | | | ○ | ○ | | | ○ | ○ | | ○ | ○ | ○ | |
| 164 | | ○ | ○ | ○ | | | | ○ | | ○ | ○ | | | ○ | ○ | | ○ | | | | ○ | ○ | ○ | |
| 165 | | ○ | ○ | ○ | | | ○ | ○ | | ○ | ○ | | | ○ | ○ | | ○ | ○ | | | ○ | ○ | ○ | |
| 166 | | ○ | ○ | ○ | | ○ | | ○ | | ○ | ○ | | | ○ | ○ | | ○ | | ○ | | ○ | ○ | ○ | |
| 167 | | ○ | ○ | ○ | | ○ | ○ | ○ | | ○ | ○ | | | ○ | ○ | | ○ | ○ | ○ | | ○ | ○ | ○ | |
| 168 | | ○ | ○ | ○ | ○ | | | | | ○ | ○ | | | ○ | ○ | | | | | ○ | ○ | ○ | ○ | |
| 169 | | ○ | ○ | ○ | ○ | | ○ | | | ○ | ○ | | | ○ | ○ | | | ○ | | ○ | ○ | ○ | ○ | |
| 170 | | ○ | ○ | ○ | ○ | ○ | | | | ○ | ○ | | | ○ | ○ | | | | ○ | ○ | ○ | ○ | ○ | |
| 171 | | ○ | ○ | ○ | ○ | ○ | ○ | | | ○ | ○ | | | ○ | ○ | | | ○ | ○ | ○ | ○ | ○ | ○ | |
| 172 | | ○ | ○ | ○ | ○ | | | ○ | | ○ | ○ | | | ○ | ○ | | ○ | | | ○ | ○ | ○ | ○ | |
| 173 | | ○ | ○ | ○ | ○ | | ○ | ○ | | ○ | ○ | | | ○ | ○ | | ○ | ○ | | ○ | ○ | ○ | ○ | |
| 174 | | ○ | ○ | ○ | ○ | ○ | | ○ | | ○ | ○ | | | ○ | ○ | | ○ | | ○ | ○ | ○ | ○ | ○ | |
| 175 | | ○ | ○ | ○ | ○ | ○ | ○ | ○ | | ○ | ○ | | | ○ | ○ | | ○ | ○ | ○ | ○ | ○ | ○ | ○ | |
| 176 | | ○ | ○ | ○ | | | | | ○ | ○ | ○ | | | ○ | ○ | ○ | | | | | ○ | ○ | ○ | |
| 177 | | ○ | ○ | ○ | | | ○ | | ○ | ○ | ○ | | | ○ | ○ | ○ | | ○ | | | ○ | ○ | ○ | |
| 178 | | ○ | ○ | ○ | | ○ | | | ○ | ○ | ○ | | | ○ | ○ | ○ | | | ○ | | ○ | ○ | ○ | |
| 179 | | ○ | ○ | ○ | | ○ | ○ | | ○ | ○ | ○ | | | ○ | ○ | ○ | | ○ | ○ | | ○ | ○ | ○ | |
| 180 | | ○ | ○ | ○ | | | | ○ | ○ | ○ | ○ | | | ○ | ○ | ○ | ○ | | | | ○ | ○ | ○ | |
| 181 | | ○ | ○ | ○ | | | ○ | ○ | ○ | ○ | ○ | | | ○ | ○ | ○ | ○ | ○ | | | ○ | ○ | ○ | |
| 182 | | ○ | ○ | ○ | | ○ | | ○ | ○ | ○ | ○ | | | ○ | ○ | ○ | ○ | | ○ | | ○ | ○ | ○ | |
| 183 | | ○ | ○ | ○ | | ○ | ○ | ○ | ○ | ○ | ○ | | | ○ | ○ | ○ | ○ | ○ | ○ | | ○ | ○ | ○ | |
| 184 | | ○ | ○ | ○ | ○ | | | | ○ | ○ | ○ | | | ○ | ○ | ○ | | | | ○ | ○ | ○ | ○ | |
| 185 | | ○ | ○ | ○ | ○ | | ○ | | ○ | ○ | ○ | | | ○ | ○ | ○ | | ○ | | ○ | ○ | ○ | ○ | |
| 186 | | ○ | ○ | ○ | ○ | ○ | | | ○ | ○ | ○ | | | ○ | ○ | ○ | | | ○ | ○ | ○ | ○ | ○ | |
| 187 | | ○ | ○ | ○ | ○ | ○ | ○ | | ○ | ○ | ○ | | | ○ | ○ | ○ | | ○ | ○ | ○ | ○ | ○ | ○ | |
| 188 | | ○ | ○ | ○ | ○ | | | ○ | ○ | ○ | ○ | | | ○ | ○ | ○ | ○ | | | ○ | ○ | ○ | ○ | |
| 189 | | ○ | ○ | ○ | ○ | | ○ | ○ | ○ | ○ | ○ | | | ○ | ○ | ○ | ○ | ○ | | ○ | ○ | ○ | ○ | |
| 190 | | ○ | ○ | ○ | ○ | ○ | | ○ | ○ | ○ | ○ | | | ○ | ○ | ○ | ○ | | ○ | ○ | ○ | ○ | ○ | |

FIG. 12

| | GROUP A | | | | | | | | | | | | GROUP B | | | | | | | | | | | |
|---|---|---|---|---|---|---|---|---|---|---|---|---|---|---|---|---|---|---|---|---|---|---|---|---|
| No. OF SF | SF12a | SF10a | SF8a | SF6a | SF4a | SF2a | SF1a | SF3a | SF5a | SF7a | SF9a | SF11a | SF11b | SF9b | SF7b | SF5b | SF3b | SF1b | SF2b | SF4b | SF6b | SF8b | SF10b | SF12b |
| WEIGHTING OF SF→ | 32/2 | 32/2 | 32/2 | 32/2 | 8/2 | 2/2 | 1/2 | 4/2 | 16/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 |
| GRADATION ↓ | | | | | | | | | | | | | | | | | | | | | | | | |
| 191 | | o | o | o | o | o | o | o | o | o | o | | | o | o | o | o | o | o | o | o | o | o | |
| 192 | | o | o | o | | | | | | o | o | o | o | o | o | | | | | | o | o | o | |
| 193 | | o | o | o | | | o | | | o | o | o | o | o | o | | | o | | | o | o | o | |
| 194 | | o | o | o | | o | | | | o | o | o | o | o | o | | | | o | | o | o | o | |
| 195 | | o | o | o | | o | o | | | o | o | o | o | o | o | | | o | o | | o | o | o | |
| 196 | | o | o | o | | | | o | | o | o | o | o | o | o | | o | | | | o | o | o | |
| 197 | | o | o | o | | | o | o | | o | o | o | o | o | o | | o | o | | | o | o | o | |
| 198 | | o | o | o | | o | | o | | o | o | o | o | o | o | | o | | o | | o | o | o | |
| 199 | | o | o | o | | o | o | o | | o | o | o | o | o | o | | o | o | o | | o | o | o | |
| 200 | | o | o | o | o | | | | | o | o | o | o | o | o | | | | | o | o | o | o | |
| 201 | | o | o | o | o | | o | | | o | o | o | o | o | o | | | o | | o | o | o | o | |
| 202 | | o | o | o | o | o | | | | o | o | o | o | o | o | | | | o | o | o | o | o | |
| 203 | | o | o | o | o | o | o | | | o | o | o | o | o | o | | | o | o | o | o | o | o | |
| 204 | | o | o | o | o | | | o | | o | o | o | o | o | o | | o | | | o | o | o | o | |
| 205 | | o | o | o | o | | o | o | | o | o | o | o | o | o | | o | o | | o | o | o | o | |
| 206 | | o | o | o | o | o | | o | | o | o | o | o | o | o | | o | | o | o | o | o | o | |
| 207 | | o | o | o | o | o | o | o | | o | o | o | o | o | o | | o | o | o | o | o | o | o | |
| 208 | | o | o | o | | | | | o | o | o | o | o | o | o | o | | | | | o | o | o | |
| 209 | | o | o | o | | | o | | o | o | o | o | o | o | o | o | | o | | | o | o | o | |
| 210 | | o | o | o | | o | | | o | o | o | o | o | o | o | o | | | o | | o | o | o | |
| 211 | | o | o | o | | o | o | | o | o | o | o | o | o | o | o | | o | o | | o | o | o | |
| 212 | | o | o | o | | | | o | o | o | o | o | o | o | o | o | o | | | | o | o | o | |
| 213 | | o | o | o | | | o | o | o | o | o | o | o | o | o | o | o | o | | | o | o | o | |
| 214 | | o | o | o | | o | | o | o | o | o | o | o | o | o | o | o | | o | | o | o | o | |
| 215 | | o | o | o | | o | o | o | o | o | o | o | o | o | o | o | o | o | o | | o | o | o | |
| 216 | | o | o | o | o | | | | o | o | o | o | o | o | o | o | | | | o | o | o | o | |
| 217 | | o | o | o | o | | o | | o | o | o | o | o | o | o | o | | o | | o | o | o | o | |
| 218 | | o | o | o | o | o | | | o | o | o | o | o | o | o | o | | | o | o | o | o | o | |
| 219 | | o | o | o | o | o | o | | o | o | o | o | o | o | o | o | | o | o | o | o | o | o | |
| 220 | | o | o | o | o | | | o | o | o | o | o | o | o | o | o | o | | | o | o | o | o | |
| 221 | | o | o | o | o | | o | o | o | o | o | o | o | o | o | o | o | o | | o | o | o | o | |
| 222 | | o | o | o | o | o | | o | o | o | o | o | o | o | o | o | o | | o | o | o | o | o | |
| 223 | | o | o | o | o | o | o | o | o | o | o | o | o | o | o | o | o | o | o | o | o | o | o | |
| 224 | o | o | o | o | | | | | | o | o | o | o | o | o | | | | | | o | o | o | o |
| 225 | o | o | o | o | | | o | | | o | o | o | o | o | o | | | o | | | o | o | o | o |
| 226 | o | o | o | o | | o | | | | o | o | o | o | o | o | | | | o | | o | o | o | o |
| 227 | o | o | o | o | | o | o | | | o | o | o | o | o | o | | | o | o | | o | o | o | o |
| 228 | o | o | o | o | | | | o | | o | o | o | o | o | o | | o | | | | o | o | o | o |
| 229 | o | o | o | o | | | o | o | | o | o | o | o | o | o | | o | o | | | o | o | o | o |
| 230 | o | o | o | o | | o | | o | | o | o | o | o | o | o | | o | | o | | o | o | o | o |
| 231 | o | o | o | o | | o | o | o | | o | o | o | o | o | o | | o | o | o | | o | o | o | o |
| 232 | o | o | o | o | o | | | | | o | o | o | o | o | o | | | | | o | o | o | o | o |
| 233 | o | o | o | o | o | | o | | | o | o | o | o | o | o | | | o | | o | o | o | o | o |
| 234 | o | o | o | o | o | o | | | | o | o | o | o | o | o | | | | o | o | o | o | o | o |
| 235 | o | o | o | o | o | o | o | | | o | o | o | o | o | o | | | o | o | o | o | o | o | o |
| 236 | o | o | o | o | o | | | o | | o | o | o | o | o | o | | o | | | o | o | o | o | o |
| 237 | o | o | o | o | o | | o | o | | o | o | o | o | o | o | | o | o | | o | o | o | o | o |
| 238 | o | o | o | o | o | o | | o | | o | o | o | o | o | o | | o | | o | o | o | o | o | o |
| 239 | o | o | o | o | o | o | o | o | | o | o | o | o | o | o | | o | o | o | o | o | o | o | o |
| 240 | o | o | o | o | | | | | o | o | o | o | o | o | o | o | | | | | o | o | o | o |
| 241 | o | o | o | o | | | o | | o | o | o | o | o | o | o | o | | o | | | o | o | o | o |
| 242 | o | o | o | o | | o | | | o | o | o | o | o | o | o | o | | | o | | o | o | o | o |
| 243 | o | o | o | o | | o | o | | o | o | o | o | o | o | o | o | | o | o | | o | o | o | o |
| 244 | o | o | o | o | | | | o | o | o | o | o | o | o | o | o | o | | | | o | o | o | o |
| 245 | o | o | o | o | | | o | o | o | o | o | o | o | o | o | o | o | o | | | o | o | o | o |
| 246 | o | o | o | o | | o | | o | o | o | o | o | o | o | o | o | o | | o | | o | o | o | o |
| 247 | o | o | o | o | | o | o | o | o | o | o | o | o | o | o | o | o | o | o | | o | o | o | o |
| 248 | o | o | o | o | o | | | | o | o | o | o | o | o | o | o | | | | o | o | o | o | o |
| 249 | o | o | o | o | o | | o | | o | o | o | o | o | o | o | o | | o | | o | o | o | o | o |
| 250 | o | o | o | o | o | o | | | o | o | o | o | o | o | o | o | | | o | o | o | o | o | o |
| 251 | o | o | o | o | o | o | o | | o | o | o | o | o | o | o | o | | o | o | o | o | o | o | o |
| 252 | o | o | o | o | o | | | o | o | o | o | o | o | o | o | o | o | | | o | o | o | o | o |
| 253 | o | o | o | o | o | | o | o | o | o | o | o | o | o | o | o | o | o | | o | o | o | o | o |
| 254 | o | o | o | o | o | o | | o | o | o | o | o | o | o | o | o | o | | o | o | o | o | o | o |
| 255 | o | o | o | o | o | o | o | o | o | o | o | o | o | o | o | o | o | o | o | o | o | o | o | o |

FIG. 14

| | GROUP A | | | | | | | NO DIVIDING | | | | | GROUP B | | | | | | |
|---|---|---|---|---|---|---|---|---|---|---|---|---|---|---|---|---|---|---|---|
| No. OF SF | SF12a | SF10a | SF8a | SF6a | SF7a | SF9a | SF11a | SF5 | SF3 | SF1 | SF2 | SF4 | SF11b | SF9b | SF7b | SF6b | SF8b | SF10b | SF12b |
| WEIGHTING OF SF→ | 32/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 | 32/2 | 32/2 | 32/2 |
| GRADATION ↓ | | | | | | | | | | | | | | | | | | | |
| 0 | | | | | | | | | | | | | | | | | | | |
| 1 | | | | | | | | | | o | | | | | | | | | |
| 2 | | | | | | | | | | | o | | | | | | | | |
| 3 | | | | | | | | | | o | o | | | | | | | | |
| 4 | | | | | | | | | o | | | | | | | | | | |
| 5 | | | | | | | | | o | o | | | | | | | | | |
| 6 | | | | | | | | | o | | o | | | | | | | | |
| 7 | | | | | | | | | o | o | o | | | | | | | | |
| 8 | | | | | | | | | | | | o | | | | | | | |
| 9 | | | | | | | | | | o | | o | | | | | | | |
| 10 | | | | | | | | | | | o | o | | | | | | | |
| 11 | | | | | | | | | | o | o | o | | | | | | | |
| 12 | | | | | | | | | o | | | o | | | | | | | |
| 13 | | | | | | | | | o | o | | o | | | | | | | |
| 14 | | | | | | | | | o | | o | o | | | | | | | |
| 15 | | | | | | | | | o | o | o | o | | | | | | | |
| 16 | | | | | | | | o | | | | | | | | | | | |
| 17 | | | | | | | | o | | o | | | | | | | | | |
| 18 | | | | | | | | o | | | o | | | | | | | | |
| 19 | | | | | | | | o | | o | o | | | | | | | | |
| 20 | | | | | | | | o | o | | | | | | | | | | |
| 21 | | | | | | | | o | o | o | | | | | | | | | |
| 22 | | | | | | | | o | o | | o | | | | | | | | |
| 23 | | | | | | | | o | o | o | o | | | | | | | | |
| 24 | | | | | | | | o | | | | o | | | | | | | |
| 25 | | | | | | | | o | | o | | o | | | | | | | |
| 26 | | | | | | | | o | | | o | o | | | | | | | |
| 27 | | | | | | | | o | | o | o | o | | | | | | | |
| 28 | | | | | | | | o | o | | | o | | | | | | | |
| 29 | | | | | | | | o | o | o | | o | | | | | | | |
| 30 | | | | | | | | o | o | | o | o | | | | | | | |
| 31 | | | | | | | | o | o | o | o | o | | | | | | | |
| 32 | | | | o | | | | | | | | | | | | o | | | |
| 33 | | | | o | | | | | | o | | | | | | o | | | |
| 34 | | | | o | | | | | | | o | | | | | o | | | |
| 35 | | | | o | | | | | | o | o | | | | | o | | | |
| 36 | | | | o | | | | | o | | | | | | | o | | | |
| 37 | | | | o | | | | | o | o | | | | | | o | | | |
| 38 | | | | o | | | | | o | | o | | | | | o | | | |
| 39 | | | | o | | | | | o | o | o | | | | | o | | | |
| 40 | | | | o | | | | | | | | o | | | | o | | | |
| 41 | | | | o | | | | | | o | | o | | | | o | | | |
| 42 | | | | o | | | | | | | o | o | | | | o | | | |
| 43 | | | | o | | | | | | o | o | o | | | | o | | | |
| 44 | | | | o | | | | | o | | | o | | | | o | | | |
| 45 | | | | o | | | | | o | o | | o | | | | o | | | |
| 46 | | | | o | | | | | o | | o | o | | | | o | | | |
| 47 | | | | o | | | | | o | o | o | o | | | | o | | | |

FIG. 15

| | GROUP A | | | | | | | NO DIVIDING | | | | | GROUP B | | | | | | |
|---|---|---|---|---|---|---|---|---|---|---|---|---|---|---|---|---|---|---|---|
| No. OF SF | SF12a | SF10a | SF8a | SF6a | SF7a | SF9a | SF11a | SF5 | SF3 | SF1 | SF2 | SF4 | SF11b | SF9b | SF7b | SF6b | SF8b | SF10b | SF12b |
| WEIGHTING OF SF→ | 32/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 | 32/2 | 32/2 | 32/2 |
| GRADATION ↓ | | | | | | | | | | | | | | | | | | | |
| 48 | | | | ○ | | | | ○ | | | | | | | | ○ | | | |
| 49 | | | | ○ | | | | ○ | | ○ | | | | | | ○ | | | |
| 50 | | | | ○ | | | | ○ | | | ○ | | | | | ○ | | | |
| 51 | | | | ○ | | | | ○ | | ○ | ○ | | | | | ○ | | | |
| 52 | | | | ○ | | | | ○ | ○ | | | | | | | ○ | | | |
| 53 | | | | ○ | | | | ○ | ○ | ○ | | | | | | ○ | | | |
| 54 | | | | ○ | | | | ○ | ○ | | ○ | | | | | ○ | | | |
| 55 | | | | ○ | | | | ○ | ○ | ○ | ○ | | | | | ○ | | | |
| 56 | | | | ○ | | | | ○ | | | | ○ | | | | ○ | | | |
| 57 | | | | ○ | | | | ○ | | ○ | | ○ | | | | ○ | | | |
| 58 | | | | ○ | | | | ○ | | | ○ | ○ | | | | ○ | | | |
| 59 | | | | ○ | | | | ○ | | ○ | ○ | ○ | | | | ○ | | | |
| 60 | | | | ○ | | | | ○ | ○ | | | ○ | | | | ○ | | | |
| 61 | | | | ○ | | | | ○ | ○ | ○ | | ○ | | | | ○ | | | |
| 62 | | | | ○ | | | | ○ | ○ | | ○ | ○ | | | | ○ | | | |
| 63 | | | | ○ | | | | ○ | ○ | ○ | ○ | ○ | | | | ○ | | | |
| 64 | | | | ○ | ○ | | | | | | | | | | ○ | ○ | | | |
| 65 | | | | ○ | ○ | | | | | ○ | | | | | ○ | ○ | | | |
| 66 | | | | ○ | ○ | | | | | | ○ | | | | ○ | ○ | | | |
| 67 | | | | ○ | ○ | | | | | ○ | ○ | | | | ○ | ○ | | | |
| 68 | | | | ○ | ○ | | | | ○ | | | | | | ○ | ○ | | | |
| 69 | | | | ○ | ○ | | | | ○ | ○ | | | | | ○ | ○ | | | |
| 70 | | | | ○ | ○ | | | | ○ | | ○ | | | | ○ | ○ | | | |
| 71 | | | | ○ | ○ | | | | ○ | ○ | ○ | | | | ○ | ○ | | | |
| 72 | | | | ○ | ○ | | | | | | | ○ | | | ○ | ○ | | | |
| 73 | | | | ○ | ○ | | | | | ○ | | ○ | | | ○ | ○ | | | |
| 74 | | | | ○ | ○ | | | | | | ○ | ○ | | | ○ | ○ | | | |
| 75 | | | | ○ | ○ | | | | | ○ | ○ | ○ | | | ○ | ○ | | | |
| 76 | | | | ○ | ○ | | | | ○ | | | ○ | | | ○ | ○ | | | |
| 77 | | | | ○ | ○ | | | | ○ | ○ | | ○ | | | ○ | ○ | | | |
| 78 | | | | ○ | ○ | | | | ○ | | ○ | ○ | | | ○ | ○ | | | |
| 79 | | | | ○ | ○ | | | | ○ | ○ | ○ | ○ | | | ○ | ○ | | | |
| 80 | | | | ○ | ○ | | | ○ | | | | | | | ○ | ○ | | | |
| 81 | | | | ○ | ○ | | | ○ | | ○ | | | | | ○ | ○ | | | |
| 82 | | | | ○ | ○ | | | ○ | | | ○ | | | | ○ | ○ | | | |
| 83 | | | | ○ | ○ | | | ○ | | ○ | ○ | | | | ○ | ○ | | | |
| 84 | | | | ○ | ○ | | | ○ | ○ | | | | | | ○ | ○ | | | |
| 85 | | | | ○ | ○ | | | ○ | ○ | ○ | | | | | ○ | ○ | | | |
| 86 | | | | ○ | ○ | | | ○ | ○ | | ○ | | | | ○ | ○ | | | |
| 87 | | | | ○ | ○ | | | ○ | ○ | ○ | ○ | | | | ○ | ○ | | | |
| 88 | | | | ○ | ○ | | | ○ | | | | ○ | | | ○ | ○ | | | |
| 89 | | | | ○ | ○ | | | ○ | | ○ | | ○ | | | ○ | ○ | | | |
| 90 | | | | ○ | ○ | | | ○ | | | ○ | ○ | | | ○ | ○ | | | |
| 91 | | | | ○ | ○ | | | ○ | | ○ | ○ | ○ | | | ○ | ○ | | | |
| 92 | | | | ○ | ○ | | | ○ | ○ | | | ○ | | | ○ | ○ | | | |
| 93 | | | | ○ | ○ | | | ○ | ○ | ○ | | ○ | | | ○ | ○ | | | |
| 94 | | | | ○ | ○ | | | ○ | ○ | | ○ | ○ | | | ○ | ○ | | | |
| 95 | | | | ○ | ○ | | | ○ | ○ | ○ | ○ | ○ | | | ○ | ○ | | | |
| 96 | | | ○ | ○ | ○ | | | | | | | | | | ○ | ○ | ○ | | |

FIG. 16

| | GROUP A | | | | | | | NO DIVIDING | | | | | GROUP B | | | | | | |
|---|---|---|---|---|---|---|---|---|---|---|---|---|---|---|---|---|---|---|---|
| No. OF SF | SF12a | SF10a | SF8a | SF6a | SF7a | SF9a | SF11a | SF5 | SF3 | SF1 | SF2 | SF4 | SF11b | SF9b | SF7b | SF6b | SF8b | SF10b | SF12b |
| WEIGHTING OF SF→ | 32/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 | 32/2 | 32/2 | 32/2 |
| GRADATION ↓ | | | | | | | | | | | | | | | | | | | |
| 97 | | | O | O | O | | | | | O | | | | | O | O | O | | |
| 98 | | | O | O | O | | | | | | O | | | | O | O | O | | |
| 99 | | | O | O | O | | | | | O | O | | | | O | O | O | | |
| 100 | | | O | O | O | | | | O | | | | | | O | O | O | | |
| 101 | | | O | O | O | | | | O | O | | | | | O | O | O | | |
| 102 | | | O | O | O | | | | O | | O | | | | O | O | O | | |
| 103 | | | O | O | O | | | | O | O | O | | | | O | O | O | | |
| 104 | | | O | O | O | | | | | | | O | | | O | O | O | | |
| 105 | | | O | O | O | | | | | O | | O | | | O | O | O | | |
| 106 | | | O | O | O | | | | | | O | O | | | O | O | O | | |
| 107 | | | O | O | O | | | | | O | O | O | | | O | O | O | | |
| 108 | | | O | O | O | | | | O | | | O | | | O | O | O | | |
| 109 | | | O | O | O | | | | O | O | | O | | | O | O | O | | |
| 110 | | | O | O | O | | | | O | | O | O | | | O | O | O | | |
| 111 | | | O | O | O | | | | O | O | O | O | | | O | O | O | | |
| 112 | | | O | O | O | | | O | | | | | | | O | O | O | | |
| 113 | | | O | O | O | | | O | | O | | | | | O | O | O | | |
| 114 | | | O | O | O | | | O | | | O | | | | O | O | O | | |
| 115 | | | O | O | O | | | O | | O | O | | | | O | O | O | | |
| 116 | | | O | O | O | | | O | O | | | | | | O | O | O | | |
| 117 | | | O | O | O | | | O | O | O | | | | | O | O | O | | |
| 118 | | | O | O | O | | | O | O | | O | | | | O | O | O | | |
| 119 | | | O | O | O | | | O | O | O | O | | | | O | O | O | | |
| 120 | | | O | O | O | | | O | | | | O | | | O | O | O | | |
| 121 | | | O | O | O | | | O | | O | | O | | | O | O | O | | |
| 122 | | | O | O | O | | | O | | | O | O | | | O | O | O | | |
| 123 | | | O | O | O | | | O | | O | O | O | | | O | O | O | | |
| 124 | | | O | O | O | | | O | O | | | O | | | O | O | O | | |
| 125 | | | O | O | O | | | O | O | O | | O | | | O | O | O | | |
| 126 | | | O | O | O | | | O | O | | O | O | | | O | O | O | | |
| 127 | | | O | O | O | | | O | O | O | O | O | | | O | O | O | | |
| 128 | | | O | O | O | O | | | | | | | | O | O | O | O | | |
| 129 | | | O | O | O | O | | | | O | | | | O | O | O | O | | |
| 130 | | | O | O | O | O | | | | | O | | | O | O | O | O | | |
| 131 | | | O | O | O | O | | | | O | O | | | O | O | O | O | | |
| 132 | | | O | O | O | O | | | O | | | | | O | O | O | O | | |
| 133 | | | O | O | O | O | | | O | O | | | | O | O | O | O | | |
| 134 | | | O | O | O | O | | | O | | O | | | O | O | O | O | | |
| 135 | | | O | O | O | O | | | O | O | O | | | O | O | O | O | | |
| 136 | | | O | O | O | O | | | | | | O | | O | O | O | O | | |
| 137 | | | O | O | O | O | | | | O | | O | | O | O | O | O | | |
| 138 | | | O | O | O | O | | | | | O | O | | O | O | O | O | | |
| 139 | | | O | O | O | O | | | | O | O | O | | O | O | O | O | | |
| 140 | | | O | O | O | O | | | O | | | O | | O | O | O | O | | |
| 141 | | | O | O | O | O | | | O | O | | O | | O | O | O | O | | |
| 142 | | | O | O | O | O | | | O | | O | O | | O | O | O | O | | |
| 143 | | | O | O | O | O | | | O | O | O | O | | O | O | O | O | | |
| 144 | | | O | O | O | O | | O | | | | | | O | O | O | O | | |
| 145 | | | O | O | O | O | | O | | O | | | | O | O | O | O | | |
| 146 | | | O | O | O | O | | O | | | O | | | O | O | O | O | | |

FIG. 17

| | GROUP A | | | | | | | NO DIVIDING | | | | | GROUP B | | | | | | |
|---|---|---|---|---|---|---|---|---|---|---|---|---|---|---|---|---|---|---|---|
| No. OF SF | SF12a | SF10a | SF8a | SF6a | SF7a | SF9a | SF11a | SF5 | SF3 | SF1 | SF2 | SF4 | SF11b | SF9b | SF7b | SF6b | SF8b | SF10b | SF12b |
| WEIGHTING OF SF→ | 32/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 | 32/2 | 32/2 | 32/2 |
| GRADATION ↓ | | | | | | | | | | | | | | | | | | | |
| 147 | | | O | O | O | O | | O | | O | O | | | O | O | O | O | | |
| 148 | | | O | O | O | O | | O | O | | | | | O | O | O | O | | |
| 149 | | | O | O | O | O | | O | O | O | | | | O | O | O | O | | |
| 150 | | | O | O | O | O | | O | O | | O | | | O | O | O | O | | |
| 151 | | | O | O | O | O | | O | O | O | O | | | O | O | O | O | | |
| 152 | | | O | O | O | O | | O | | | | O | | O | O | O | O | | |
| 153 | | | O | O | O | O | | O | | O | | O | | O | O | O | O | | |
| 154 | | | O | O | O | O | | O | | | O | O | | O | O | O | O | | |
| 155 | | | O | O | O | O | | O | | O | O | O | | O | O | O | O | | |
| 156 | | | O | O | O | O | | O | O | | | O | | O | O | O | O | | |
| 157 | | | O | O | O | O | | O | O | O | | O | | O | O | O | O | | |
| 158 | | | O | O | O | O | | O | O | | O | O | | O | O | O | O | | |
| 159 | | | O | O | O | O | | O | O | O | O | O | | O | O | O | O | | |
| 160 | | O | O | O | O | O | | | | | | | | O | O | O | O | O | |
| 161 | | O | O | O | O | O | | | | O | | | | O | O | O | O | O | |
| 162 | | O | O | O | O | O | | | | | O | | | O | O | O | O | O | |
| 163 | | O | O | O | O | O | | | | O | O | | | O | O | O | O | O | |
| 164 | | O | O | O | O | O | | | O | | | | | O | O | O | O | O | |
| 165 | | O | O | O | O | O | | | O | O | | | | O | O | O | O | O | |
| 166 | | O | O | O | O | O | | | O | | O | | | O | O | O | O | O | |
| 167 | | O | O | O | O | O | | | O | O | O | | | O | O | O | O | O | |
| 168 | | O | O | O | O | O | | | | | | O | | O | O | O | O | O | |
| 169 | | O | O | O | O | O | | | | O | | O | | O | O | O | O | O | |
| 170 | | O | O | O | O | O | | | | | O | O | | O | O | O | O | O | |
| 171 | | O | O | O | O | O | | | | O | O | O | | O | O | O | O | O | |
| 172 | | O | O | O | O | O | | | O | | | O | | O | O | O | O | O | |
| 173 | | O | O | O | O | O | | | O | O | | O | | O | O | O | O | O | |
| 174 | | O | O | O | O | O | | | O | | O | O | | O | O | O | O | O | |
| 175 | | O | O | O | O | O | | | O | O | O | O | | O | O | O | O | O | |
| 176 | | O | O | O | O | O | | O | | | | | | O | O | O | O | O | |
| 177 | | O | O | O | O | O | | O | | O | | | | O | O | O | O | O | |
| 178 | | O | O | O | O | O | | O | | | O | | | O | O | O | O | O | |
| 179 | | O | O | O | O | O | | O | | O | O | | | O | O | O | O | O | |
| 180 | | O | O | O | O | O | | O | O | | | | | O | O | O | O | O | |
| 181 | | O | O | O | O | O | | O | O | O | | | | O | O | O | O | O | |
| 182 | | O | O | O | O | O | | O | O | | O | | | O | O | O | O | O | |
| 183 | | O | O | O | O | O | | O | O | O | O | | | O | O | O | O | O | |
| 184 | | O | O | O | O | O | | O | | | | O | | O | O | O | O | O | |
| 185 | | O | O | O | O | O | | O | | O | | O | | O | O | O | O | O | |
| 186 | | O | O | O | O | O | | O | | | O | O | | O | O | O | O | O | |
| 187 | | O | O | O | O | O | | O | | O | O | O | | O | O | O | O | O | |
| 188 | | O | O | O | O | O | | O | O | | | O | | O | O | O | O | O | |
| 189 | | O | O | O | O | O | | O | O | O | | O | | O | O | O | O | O | |
| 190 | | O | O | O | O | O | | O | O | | O | O | | O | O | O | O | O | |
| 191 | | O | O | O | O | O | | O | O | O | O | O | | O | O | O | O | O | |
| 192 | | O | O | O | O | O | O | | | | | | O | O | O | O | O | O | |
| 193 | | O | O | O | O | O | O | | | O | | | O | O | O | O | O | O | |
| 194 | | O | O | O | O | O | O | | | | O | | O | O | O | O | O | O | |
| 195 | | O | O | O | O | O | O | | | O | O | | O | O | O | O | O | O | |
| 196 | | O | O | O | O | O | O | | O | | | | O | O | O | O | O | O | |
| 197 | | O | O | O | O | O | O | | O | O | | | O | O | O | O | O | O | |

FIG. 18

| | GROUP A | | | | | | | NO DIVIDING | | | | | GROUP B | | | | | | |
|---|---|---|---|---|---|---|---|---|---|---|---|---|---|---|---|---|---|---|---|
| No. OF SF | SF12a | SF10a | SF8a | SF6a | SF7a | SF9a | SF11a | SF5 | SF3 | SF1 | SF2 | SF4 | SF11b | SF9b | SF7b | SF6b | SF8b | SF10b | SF12b |
| WEIGHTING OF SF→ | 32/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 | 32/2 | 32/2 | 32/2 |
| GRADATION ↓ | | | | | | | | | | | | | | | | | | | |
| 198 | | O | O | O | O | O | O | | O | | O | | O | O | O | O | O | O | |
| 199 | | O | O | O | O | O | O | | O | O | O | | O | O | O | O | O | O | |
| 200 | | O | O | O | O | O | O | | | | | O | O | O | O | O | O | O | |
| 201 | | O | O | O | O | O | O | | | O | | O | O | O | O | O | O | O | |
| 202 | | O | O | O | O | O | O | | | | O | O | O | O | O | O | O | O | |
| 203 | | O | O | O | O | O | O | | | O | O | O | O | O | O | O | O | O | |
| 204 | | O | O | O | O | O | O | | O | | | O | O | O | O | O | O | O | |
| 205 | | O | O | O | O | O | O | | O | O | | O | O | O | O | O | O | O | |
| 206 | | O | O | O | O | O | O | | O | | O | O | O | O | O | O | O | O | |
| 207 | | O | O | O | O | O | O | | O | O | O | O | O | O | O | O | O | O | |
| 208 | | O | O | O | O | O | O | O | | | | | O | O | O | O | O | O | |
| 209 | | O | O | O | O | O | O | O | | O | | | O | O | O | O | O | O | |
| 210 | | O | O | O | O | O | O | O | | | O | | O | O | O | O | O | O | |
| 211 | | O | O | O | O | O | O | O | | O | O | | O | O | O | O | O | O | |
| 212 | | O | O | O | O | O | O | O | O | | | | O | O | O | O | O | O | |
| 213 | | O | O | O | O | O | O | O | O | O | | | O | O | O | O | O | O | |
| 214 | | O | O | O | O | O | O | O | O | | O | | O | O | O | O | O | O | |
| 215 | | O | O | O | O | O | O | O | O | O | O | | O | O | O | O | O | O | |
| 216 | | O | O | O | O | O | O | O | | | | O | O | O | O | O | O | O | |
| 217 | | O | O | O | O | O | O | O | | O | | O | O | O | O | O | O | O | |
| 218 | | O | O | O | O | O | O | O | | | O | O | O | O | O | O | O | O | |
| 219 | | O | O | O | O | O | O | O | | O | O | O | O | O | O | O | O | O | |
| 220 | | O | O | O | O | O | O | O | O | | | O | O | O | O | O | O | O | |
| 221 | | O | O | O | O | O | O | O | O | O | | O | O | O | O | O | O | O | |
| 222 | | O | O | O | O | O | O | O | O | | O | O | O | O | O | O | O | O | |
| 223 | | O | O | O | O | O | O | O | O | O | O | O | O | O | O | O | O | O | |
| 224 | O | O | O | O | O | O | O | | | | | | O | O | O | O | O | O | O |
| 225 | O | O | O | O | O | O | O | | | O | | | O | O | O | O | O | O | O |
| 226 | O | O | O | O | O | O | O | | | | O | | O | O | O | O | O | O | O |
| 227 | O | O | O | O | O | O | O | | | O | O | | O | O | O | O | O | O | O |
| 228 | O | O | O | O | O | O | O | | O | | | | O | O | O | O | O | O | O |
| 229 | O | O | O | O | O | O | O | | O | O | | | O | O | O | O | O | O | O |
| 230 | O | O | O | O | O | O | O | | O | | O | | O | O | O | O | O | O | O |
| 231 | O | O | O | O | O | O | O | | O | O | O | | O | O | O | O | O | O | O |
| 232 | O | O | O | O | O | O | O | | | | | O | O | O | O | O | O | O | O |
| 233 | O | O | O | O | O | O | O | | | O | | O | O | O | O | O | O | O | O |
| 234 | O | O | O | O | O | O | O | | | | O | O | O | O | O | O | O | O | O |
| 235 | O | O | O | O | O | O | O | | | O | O | O | O | O | O | O | O | O | O |
| 236 | O | O | O | O | O | O | O | | O | | | O | O | O | O | O | O | O | O |
| 237 | O | O | O | O | O | O | O | | O | O | | O | O | O | O | O | O | O | O |
| 238 | O | O | O | O | O | O | O | | O | | O | O | O | O | O | O | O | O | O |
| 239 | O | O | O | O | O | O | O | | O | O | O | O | O | O | O | O | O | O | O |
| 240 | O | O | O | O | O | O | O | O | | | | | O | O | O | O | O | O | O |
| 241 | O | O | O | O | O | O | O | O | | O | | | O | O | O | O | O | O | O |
| 242 | O | O | O | O | O | O | O | O | | | O | | O | O | O | O | O | O | O |
| 243 | O | O | O | O | O | O | O | O | | O | O | | O | O | O | O | O | O | O |
| 244 | O | O | O | O | O | O | O | O | O | | | | O | O | O | O | O | O | O |

FIG. 19

| | GROUP A | | | | | | | NO DIVIDING | | | | | GROUP B | | | | | | |
|---|---|---|---|---|---|---|---|---|---|---|---|---|---|---|---|---|---|---|---|
| No. OF SF | SF12a | SF10a | SF8a | SF6a | SF7a | SF9a | SF11a | SF5 | SF3 | SF1 | SF2 | SF4 | SF11b | SF9b | SF7b | SF6b | SF8b | SF10b | SF12b |
| WEIGHTING OF SF→ | 32/2 | 32/2 | 32/2 | 32/2 | 32/2 | 32/2 | 32/2 | 16/2 | 4/2 | 1/2 | 2/2 | 8/2 | 32/2 | 32/2 | 32/2 | 32/2 | 32/2 | 32/2 | 32/2 |
| GRADATION ↓ | | | | | | | | | | | | | | | | | | | |
| 245 | O | O | O | O | O | O | O | O | O | O | | | O | O | O | O | O | O | O |
| 246 | O | O | O | O | O | O | O | O | O | | O | | O | O | O | O | O | O | O |
| 247 | O | O | O | O | O | O | O | O | O | O | O | | O | O | O | O | O | O | O |
| 248 | O | O | O | O | O | O | O | O | | | | O | O | O | O | O | O | O | O |
| 249 | O | O | O | O | O | O | O | O | | O | | O | O | O | O | O | O | O | O |
| 250 | O | O | O | O | O | O | O | O | | | O | O | O | O | O | O | O | O | O |
| 251 | O | O | O | O | O | O | O | O | | O | O | O | O | O | O | O | O | O | O |
| 252 | O | O | O | O | O | O | O | O | O | | | O | O | O | O | O | O | O | O |
| 253 | O | O | O | O | O | O | O | O | O | O | | O | O | O | O | O | O | O | O |
| 254 | O | O | O | O | O | O | O | O | O | | O | O | O | O | O | O | O | O | O |
| 255 | O | O | O | O | O | O | O | O | O | O | O | O | O | O | O | O | O | O | O |

METHOD FOR DRIVING AN IMAGE DISPLAYING APPARATUS

BACKGROUND OF THE INVENTION

1. Field of the Invention

The present invention relates to a method for driving an image displaying apparatus using a subfield method to be applied in transmission type or projection type display or viewfinder, liquid crystal image apparatus such as head-mounting type display, plasma image displaying apparatus, digital mirror image displaying apparatus, electroluminescence image displaying apparatus, field emission image displaying apparatus, etc.

2. Description of the Related Art

In general, in a displaying apparatus based on binary display such as a plasma display or a display using digital mirror device, a subfield method is used to obtain intermediate gradation. According to this method, one field is divided into a plurality of subfields with weighting of luminance of light emission according to a predetermined law, i.e. by dividing one field into a plurality of subfields with different relative ratios of luminance, and intermediate gradation is displayed by superimposing the gradations over one field.

In recent years, displaying is performed by the subfield method on the displaying apparatus such as liquid crystal displaying apparatus or electroluminescence displaying apparatus, which can provide analog gradation. This is from the reason that, in analog gradation, variation and noise of image cell are very likely to exert influence, while, in the driving using the subfield method (hereinafter referred as "subfield driving"), the influence from variation and noise of image cell hardly occurs. When subfield driving is performed on nematic liquid crystal, it is particularly effective because the subfields to be divided in one field can be increased. Also, in the subfield driving, image signals are digitized and these can be expressed in binary values. This is more advantageous in terms of cost than analog conversion, and it is also suitable for mass production.

The image displaying apparatus of these types differ in structure and driving mode, but problems arise in that pseudo-contour occurs when animated picture is displayed due to the subfield driving as described above. For example, it is supposed here that one field has a plurality of 8-bit subfields, and these subfields have weighting of 1:2:4:8:16:32:64:128. By combining these subfields, expression can be given on gradations of 0 to 255, i.e. on 256 gradations. In this case, it appears that the pseudo-contour in animated picture is caused by time gap in light emission timing when the subfields are displayed. When moving speed of an image is high, time gap is converted to spatial lag. As a result, animated picture pseudo-contour occurs and this results in deterioration of image quality of animated picture.

FIG. 20 is a drawing to schematically explain generation of animated picture pseudo-contour. In FIG. 20, there are subfields of 1 to 8 (hereinafter, the subfields 1 to 8 are referred as "SF1 to SF8"). In the pixels adjacent to each other, gradation level shows a boundary of "127" with "128". In FIG. 20, rightward direction represents the flow of time, and SF1 to SF8 are displayed sequentially in this order. An open portion (white portion) represents off-display (in black), and the shaded portion shows on-display (in white). The higher the gradation level is, the closer it is to white color. The lower the gradation level is, the closer it is to black color. S1 to S3 as shown by arrows in FIG. 20 indicate positional shifting of visual line in the direction of height. In case the visual line is fixed at upper pixel position as shown by the arrow S1, a light passing through the white portion (indicating pixels of on-display) comes into the eyes of an observer in SF1 to SF7. In the subfield SF8, a light passing through the black portion (indicating pixels of off-display) comes into eyes. As a result, gradation level can be adequately recognized.

However, when visual line is shifted to the upper pixel position from the lower pixel position as shown by the arrow S2, a light passing through the black portion in all of SF1 to SF8 comes into eyes, and gradation level is turned to "0" (entirely in black). Therefore, due to the shifting of visual line, a line of black level appears falsely, and this is seen as a pseudo-contour.

On the other hand, when visual line is shifted from the upper pixel position to the lower pixel position as shown by the arrow S3, a light passing through white position comes into eyes of an observer in all of the subfields SF1 to SF8, and the gradation level is turned to "255" (entirely in white). Therefore, due to the shifting of visual line, a line of white level is generated falsely, and this is seen as a pseudo-contour.

Also, even when the image is not moving, display timing is different at the boundary between the pixels of "127" and the pixels of "128". As a result, a phenomenon such as pseudo-contour disturbance may occur, in which the boundary becomes conspicuous when the observer blinks.

As one of the methods to suppress the generation of the animated picture pseudo-contour as described above, a subfield pattern as shown in FIG. 21 is proposed. This is a method to divide a subfield with long display time among the subfields into a plurality of subfields with short display time (e.g. see the patent reference 1 as given below). In this example, SF7 and SF8 with total weighting of 192 are divided into 6 subfields with weighting of 32 each. In case the boundary between gradation levels "127" and "128" is shifted, the gradation level is not turned to "0" or "255" due to the shifting of visual line shown by the arrows S1 to S3 as already explained in connection with FIG. 20, and this reduces the occurrence of pseudo-contour.

Also, when vertical synchronizing signal frequency is low, improvement is made to large area flicker disturbance, which occurs in case of high luminance display (e.g. see the patent reference 2 as given below). In FIG. 22, a subfield with weighting 32 is further divided into two subfields, and time interval between the two subfields is turned to about one-half of the field, i.e. it is the so-called two-crest arrangement.

In these methods, solution is given so that extreme change does not occur in the selection pattern of subfields due to the change of the gradation level.

[Patent Reference 1]

JP-A-8-254965 Publication (Paragraph 0014-Paragraph 0015; FIG. 1)

[Patent Reference 2]

JP-A-2001-42818 Publication (Paragraph 0023; FIG. 8)

It seems that the animated picture pseudo-contour, the pseudo-contour disturbance, or flicker disturbance as described above are caused by the time gap in the weighting of light emission pattern within the field. Specifically, in all of these methods, temporal weighting of the subfield selected by gradation is different in each case.

SUMMARY OF THE INVENTION

To solve the above problems, it is an object of the present invention to provide a method for driving an image displaying apparatus, by which it is possible to suppress flicker disturbance, pseudo-contour disturbance and animated picture pseudo-contour disturbance by designing such a subfield pattern that the change of the weighting of light emission pattern within the field can be reduced to a level as low as possible.

It is another object of the present invention to provide a method for driving an image displaying apparatus, by which it is possible to design with good balance kept between the burden on the control system and the suppression of disturbances.

To attain the above object, the present invention provides a method for driving an image displaying apparatus for expressing image signals of multiple gradations by dividing one field duration into a plurality of primary subfields with different gradation levels, said method comprising the steps of:

dividing each one of said primary subfields into "2n" secondary subfields whose gradation level weighting is equal to each other, where "n" is a natural number;

forming two secondary subfield groups so that each of said two secondary subfield groups includes a plurality of secondary subfields of different gradation level weightings in such a manner that "n" secondary subfields obtained by the division belong to each of said two secondary subfield groups; and arranging said secondary subfield groups symmetrically with respect to the center of one field duration, and symmetrically arranging said secondary subfields, whose gradation level weighting is equal to each other, with respect to the center of one field duration.

Also, another aspect of the present invention provides the method for driving an image displaying apparatus as described above, wherein subfields obtained by dividing one subfield to "2n" subfields have relative ratios of luminance equal to or approximately equal to each other.

Further, another aspect of the present invention provides the method for driving an image displaying apparatus as described above, wherein the number of subfields divided to "2n" in one field is more than the number of the remaining subfields.

Also, another aspect of the present invention provides the method for driving an image displaying apparatus as described above, wherein when it is supposed that the total number of the secondary subfields to be obtained by the division in one field is "m" and when the secondary subfields obtained by the division are numbered sequentially from the one with lower gradation in the order of: SF1, SF2, SF3, SF4, SF5, SF6, . . . , SFm-1, SFm;

one of the secondary subfield groups arranged symmetrically is arranged in such manner that the secondary subfield with lower gradation is positioned at the central portion, and the secondary subfields with higher gradation are arranged from the central portion to outer side alternately in front and rear in the order of: SFm-1, . . . , SF5, SF3, SF1, SF2, SF4, SF6, . . . , SFm, the other of the secondary subfield groups arranged symmetrically are arranged with the secondary subfields with lower gradation positioned at the central portion, and the secondary subfields with higher gradation are arranged alternately in front and rear from the central portion to outer side in the order of: SFm, . . . , SF6, SF4, SF2, SF1, SF3, SF5, . . . , SFm-1.; and order of appearance of the secondary subfields in one of the secondary subfield groups and in the other of the secondary subfield groups arranged symmetrically is reversed.

Further, another aspect of the present invention provides the method for driving an image displaying apparatus as described above, wherein when it is supposed that the total number of the secondary subfields to be obtained by the division in one field is "m" and when the secondary subfields obtained by the division are numbered sequentially from the one with lower gradation in the order of: SF1, SF2, SF3, SF4, SF5, SF6, . . . , SFm-1, and SFm;

one of the secondary subfield groups symmetrically arranged is arranged in such manner that the secondary subfields with lower gradation are positioned at outer side, and the secondary subfields with higher gradation are arranged from outer side to the central portion alternately in front and rear and the secondary subfields appear in the order to SF1, SF3, SF5, . . . , SFm-1, SFm, . . . , SF6, SF4 and SF2;

the other of the secondary subfield groups arranged symmetrically are arranged with the secondary subfields with lower gradation positioned at outer side, and the secondary subfields with higher gradation are arranged alternately in front and rear from the outer side to the central portion, and the secondary subfields appear in the order of SF2, SF4, SF6, . . . , SFm, SFm-1, . . . , SF5, SF3, and SF1; and order of appearance of the secondary subfields in one of the secondary subfield groups and in the other of the secondary subfield groups arranged symmetrically is reversed.

According to the method for driving an image displaying apparatus of the present invention, the weighting of light emission within the field can be set to the same weighting or almost the same weighting in all gradation levels. As a result, it is possible to suppress the animated picture pseudo-contour perceived when an animated picture is displayed, and also to suppress flicker disturbance at the boundary of different gradations and pseudo-contour disturbance appearing at the moment of blinking.

BRIEF DESCRIPTION OF THE DRAWINGS

FIG. 2 is a table to show lighting status at each gradation level in the first embodiment of the present invention;

FIG. 3 is a table to show lighting status at each gradation level in the first embodiment of the present invention;

FIG. 4 is a table to show lighting status at each gradation level in the first embodiment of the present invention;

FIG. 5 is a table to show lighting status at each gradation level in the first embodiment of the present invention;

FIG. 6 is a table to show lighting status at each gradation level in the first embodiment of the present invention;

FIG. 7 is a table to show lighting status at each gradation level in the first embodiment of the present invention;

FIG. 9 is a table to show lighting status at each gradation level in the second embodiment of the present invention;

FIG. 10 is a table to show lighting status at each gradation level in the second embodiment of the present invention;

FIG. 11 is a table to show lighting status at each gradation level in the second embodiment of the present invention;

FIG. 12 is a table to show lighting status at each gradation level in the second embodiment of the present invention;

FIG. 14 is a table to show lighting status at each gradation level in the third embodiment of the present invention;

FIG. 15 is a table to show lighting status at each gradation level in the third embodiment of the present invention;

FIG. 16 is a table to show lighting status at each gradation level in the third embodiment of the present invention;

FIG. 17 is a table to show lighting status at each gradation level in the third embodiment of the present invention;

FIG. 18 is a table to show lighting status at each gradation level in the third embodiment of the present invention;

FIG. 19 is a table to show lighting status at each gradation level in the third embodiment of the present invention;

DESCRIPTION OF THE PREFERRED EMBODIMENTS OF THE INVENTION

Figure 1:
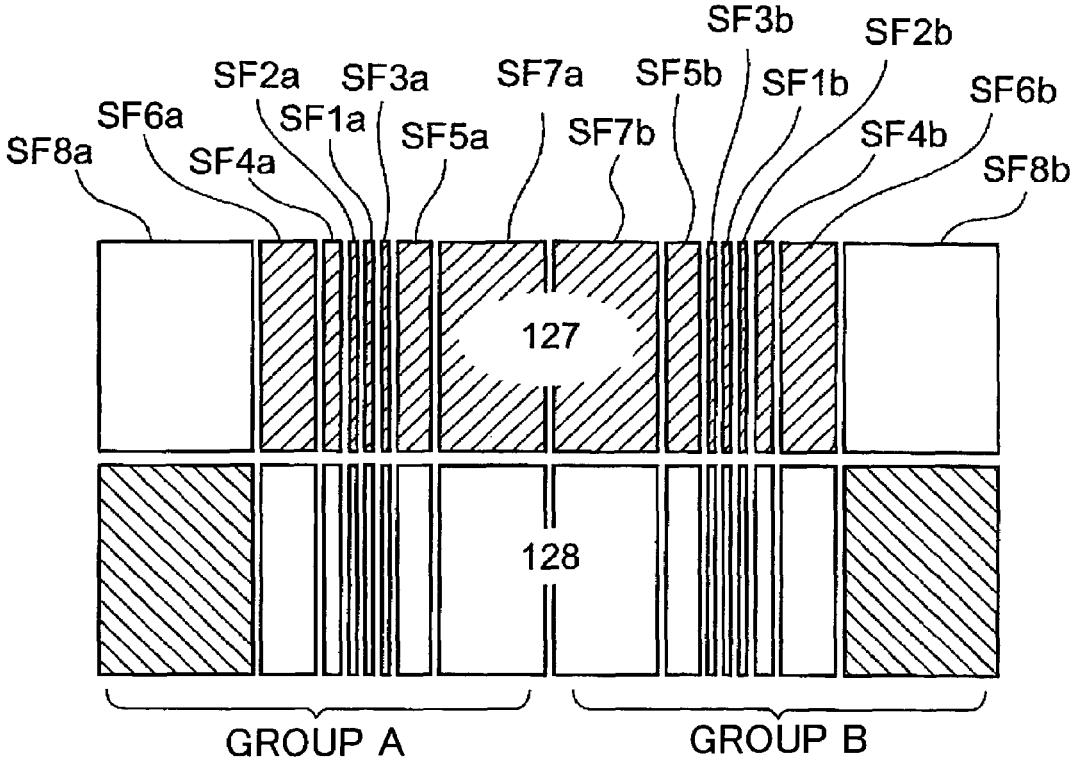
FIG. 1 is a subfield pattern of a first embodiment of a method for driving an image displaying apparatus according to the present invention.

Detailed description will be given below on the preferred embodiments of the present invention referring to the drawings.

1st Embodiment

FIG. 1 represents a subfield pattern of a first embodiment of a method for driving an image displaying apparatus according to the present invention. FIG. 2 to FIG. 7 each represents a selection pattern of subfields corresponding to each gradation level of the first embodiment.

In the present embodiment, subfields are arranged in two-crest arrangement by dividing all subfields into two groups, and the subfields are arranged symmetrically with respect to the center of each field. In this case, one of the groups arranged symmetrically is defined as Group A, and the other group is defined as Group B. When the subfields in Group A are numbered as SF1*a*, SF2*a*, SF3*a*, SF4*a*, SF5*a*, SF6*a*, SF7*a*, and SF8*a* in the order of appearance from the lowest gradation level, these are arranged alternately in front and rear in the order of display as SF8*a*, SF6*a*, SF4*a*, SF2*a*, SF1*a*, SF3*a*, SF5*a*, and SF7*a*. Also, when the subfields in Group B are numbered as SF1*b*, SF2*b*, SF3*b*, SF4*b*, SF5*b*, SF6*b*, SF7*b*, and SF8*b* in the order of appearance from the lowest gradation level, these are arranged alternately in front and rear in the order of display as SF7*b*, SF5*b*, SF3*b*, SF1*b*, SF2*b*, SF4*b*, SF6*b*, and SF8*b*. In each of the groups, subfields with the same number (e.g. SF1*a* and SF1*b*) have almost the same weighting, and the status of selection or non-selection is the same for each gradation.

FIG. 2 to FIG. 7 each represents a selection pattern of subfields over the entire range of gradation level. Because there are many gradations, these are divided and shown in 6 tables. In FIG. 2 to FIG. 7, a column with an open circle o shows a lighting (selected) status, and a column without mark shows non-lighting (non-selected) status.

In the first embodiment of the invention, a weighted center of light emission can be set at the center of the field in all gradation levels regardless of whether it is a pixel with gradation level of "127" or a pixel of "128" as shown in FIG. 1. This makes it possible to prevent animated picture pseudo-contour perceived when animation image is displayed, and flicker disturbance generated at the boundary between different gradations and also to suppress pseudo-contour disturbance, which appears at the moment of blinking.

In the first embodiment, in each of Group A and Group B, subfields with lower gradation are set at the center of each group, and subfields with higher gradations are sequentially and alternately arranged in front and rear on outer side. Instead, the same effects as described above can be obtained when subfields with lower gradations are arranged on outer side in each of Group A and Group B, and subfields with higher gradation levels are arranged sequentially and alternately in front and rear on inner side, thus reversing the order of appearance of the subfields of Group A and Group B.

2nd Embodiment

Figure 8:
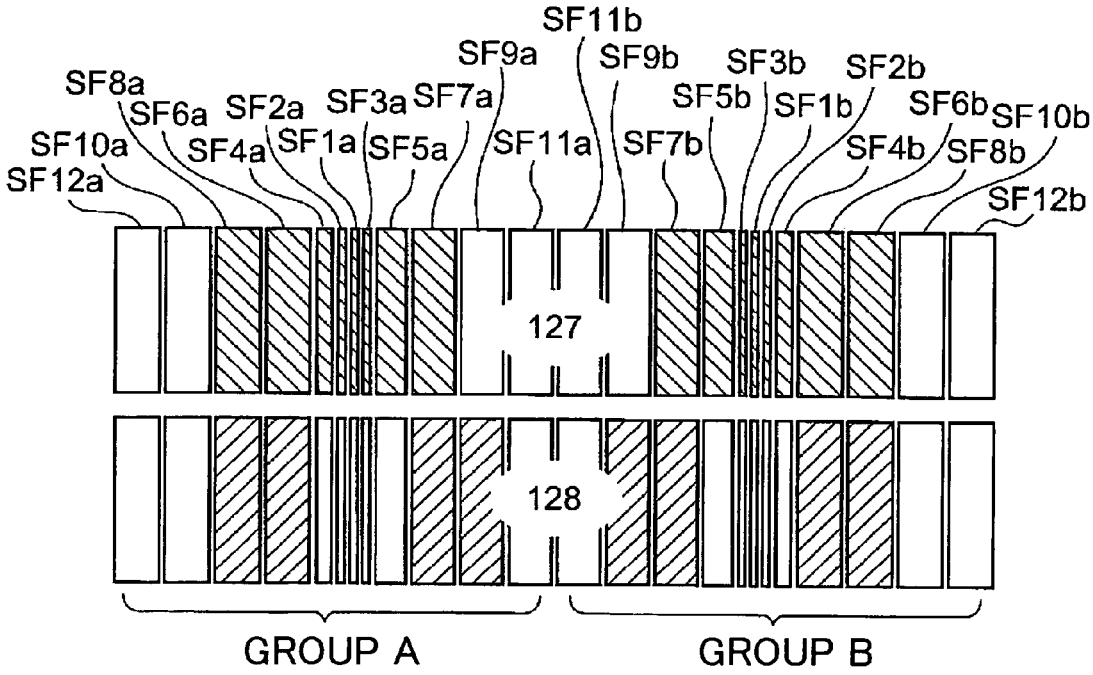
FIG. 8 shows a subfield pattern of a second embodiment of a method for driving an image displaying apparatus according to the present invention.

FIG. 8 shows a subfield pattern of a second embodiment of a method for driving an image displaying apparatus according to the present invention. FIG. 9 to FIG. 12 each represents a selection pattern of the subfields corresponding to each gradation level in the embodiment. In FIG. 9 to FIG. 12, a column with an open circle o shows lighting (selected) status, and a column without mark represents a non-lighting (non-selected) status.

In this embodiment, similarly to the first embodiment, all subfields are arranged in two-crest arrangement by dividing the subfields into two groups, and the subfields are arranged symmetrically with respect to the center of the field. This embodiment is different from the first embodiment in that the subfield with weighting 64 and the subfield with weighting 128 are divided into 6 subfields SF7 to SF12, each having the weighting of 32. Similarly to the first embodiment, these subfields SF7 to SF12 are divided respectively into SF7*a* and SF7*b*, SF8*a* and SF8*b*, SF9*a* and SF9*b*, SFlO*a* and SFlO*b*, SF11*a* and SFll*b*, and SFl2*a* and SFl2*b*, thus dividing them into two groups.

In this case, the order of display in Group A is: SF12*a*, SF10*a*, SF8*a*, SF6*a*, SF4*a*, SF2*a*, SF1*a*, SF3*a*, SF5*a*, SF7*a*, SF9*a*, and SF11*a*, being alternately arranged in front and rear. On the other hand, the order of display in Group B is symmetrical to Group A, i.e. the subfields are arranged as SF11*b*, SF9*b*, SF7*b*, SF5*b*, SF3*b*, SF1*b*, SF2*b*, SF4*b*, SF6*b*, SF8*b*, SF10*b*, and SF12*b*, being alternately arranged in front and rear. In the two groups, the subfields with same number (e.g. SF1*a* and SF1*b*) have almost the same weighting, and the selected or non-selected status is the same for each gradation.

In the second embodiment of the invention, a weighted center of light emission can be set at the center of the field in all gradation levels regardless of whether it is a pixel with gradation level of "127" or a pixel of "128" as shown in FIG. 8. This makes it possible to prevent animated picture pseudo-contour perceived when animation image is displayed, and flicker disturbance generated at the boundary between different gradations and also to suppress pseudo-contour disturbance, which appears at the moment of blinking.

In the second embodiment, in each of Group A and Group B, subfields with lower gradation are set at the center of each group, and subfields with higher gradations are sequentially and alternately arranged in front and rear on outer side. Instead, the same effects as described above can be obtained when subfields with lower gradations are arranged on outer side in each of Group A and Group B, and subfields with higher gradation levels are arranged sequentially and alternately in front and rear on inner side, thus reversing the order of appearance of the subfields of Group A and Group B.

3rd Embodiment

Figure 13:
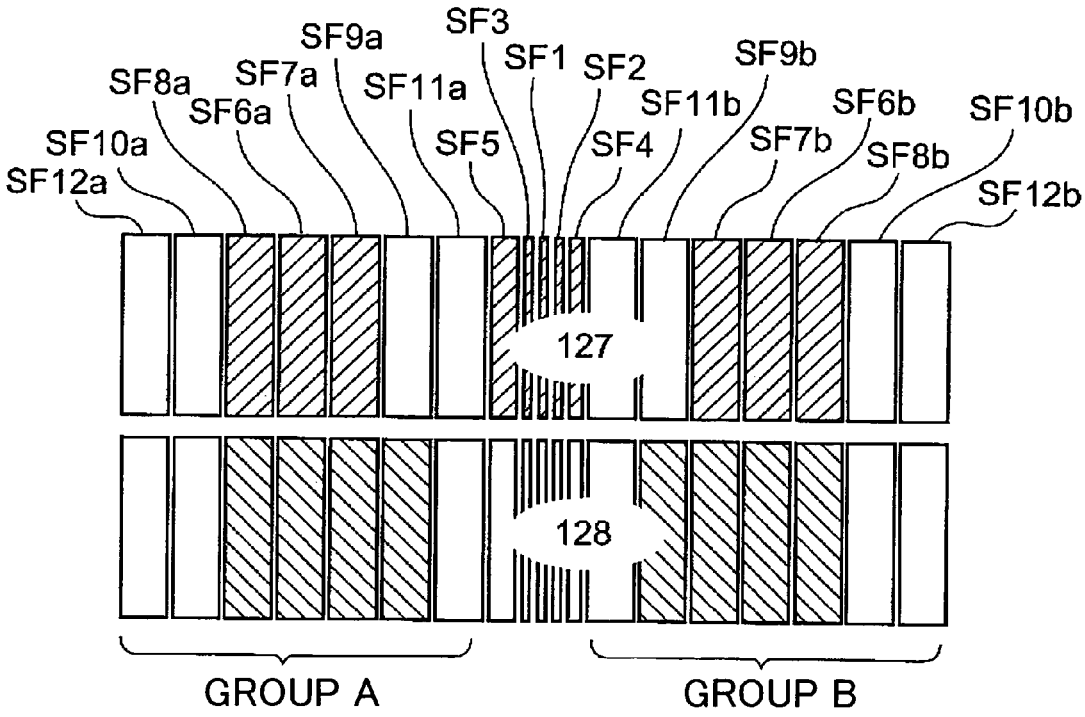
FIG. 13 shows a subfield pattern of a third embodiment of a method for driving an image displaying apparatus according to the present invention.
Figure 20:
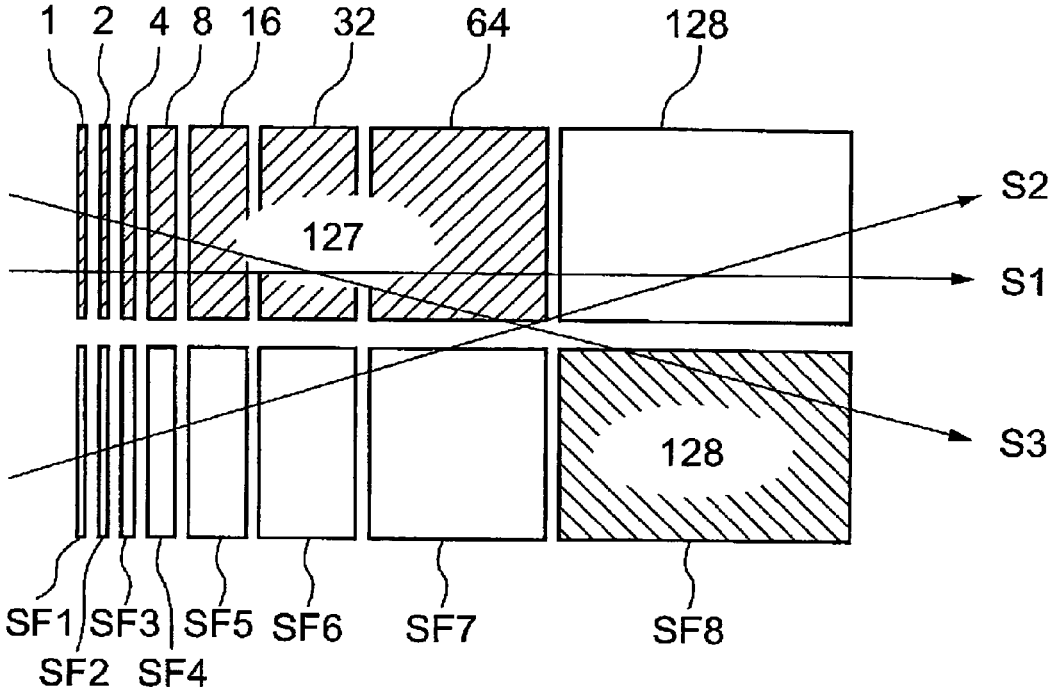
FIG. 20 PRIOR ART
FIG. 20 is a drawing of an example of arrangement of subfields of two pixels adjacent to each other to explain generation of pseudo-contour of animated picture based on a conventional method for driving an image displaying apparatus.
Figure 21:
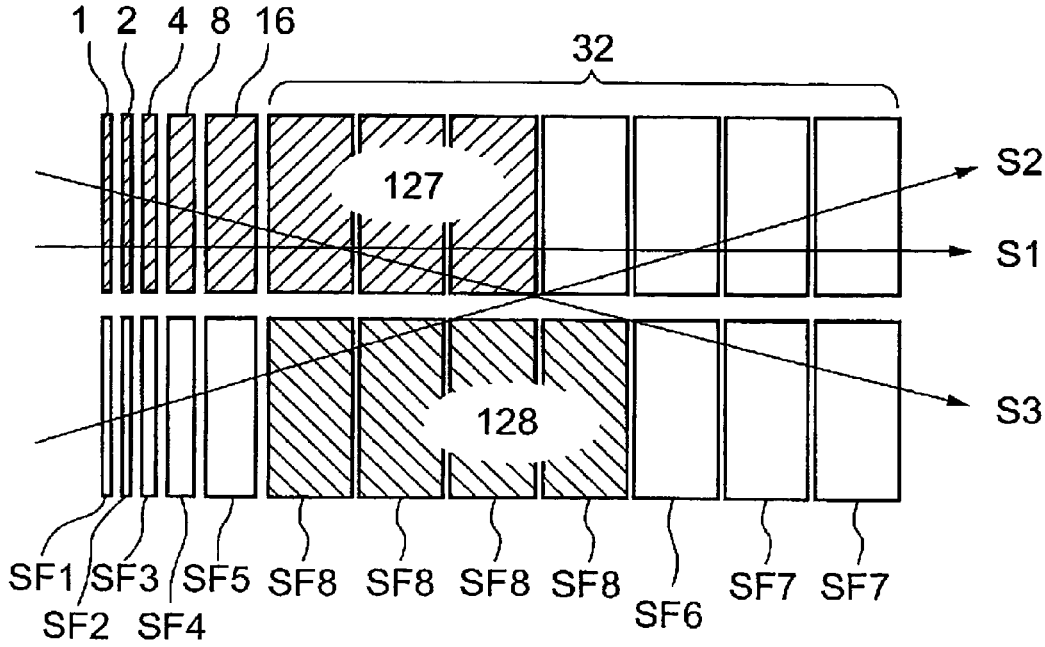
FIG. 21 PRIOR ART
FIG. 21 is a drawing of an example of arrangement of subfields of two pixels adjacent to each other to explain how to suppress generation of animated picture based on a conventional method for driving an image displaying apparatus.
Figure 22:
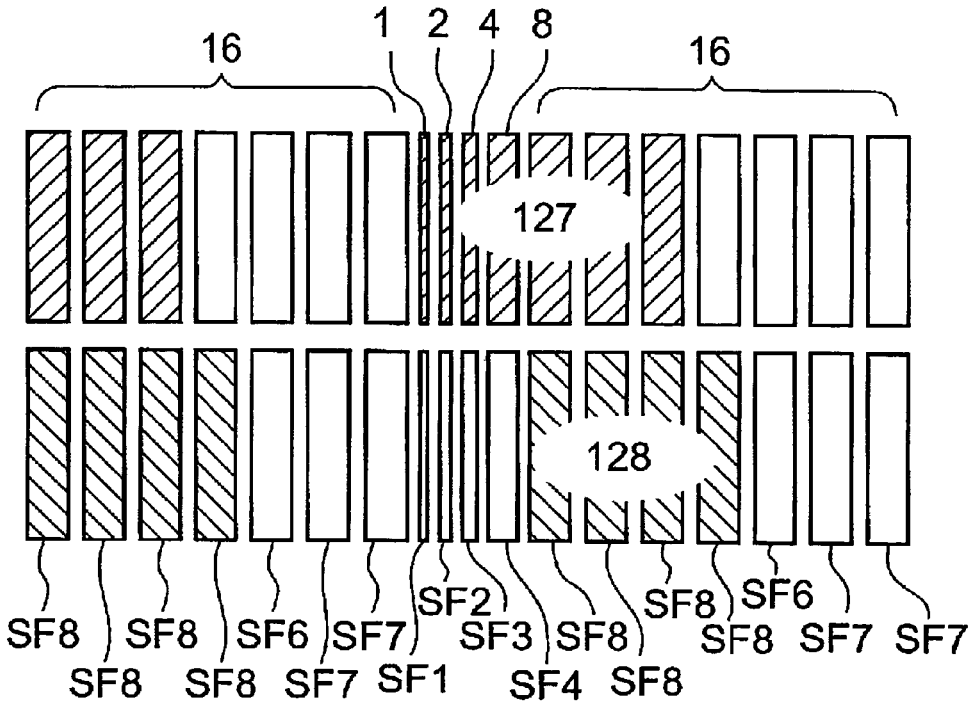
FIG. 22 PRIOR ART
FIG. 22 is a drawing of an example of arrangement of subfields of two pixels adjacent to each other to explain how to suppress generation of large area flicker in a conventional method for driving an image displaying apparatus.

FIG. 13 shows a subfield pattern of a third embodiment of the method for driving an image displaying apparatus according to the present invention. FIG. 14 to FIG. 19 each represents a selection pattern of the subfield corresponding to each gradation level of the third embodiment. In FIG. 14 to FIG. 19, a column with an open circle o represents a lighting (selected) status, and a column without mark represents a non-lighting (non-selected) status.

In this embodiment, the subfield with weighting 64 and the subfield with weighting 128 are divided to 6 subfields SF7 to SF12 respectively, each of which has weighting of 32, and the subfields SF6 to SF12 each having weighting 32 are divided to two groups as in the second embodiment. The third embodiment is different from the second embodiment in that the subfields SF1 to SF5 with weighting of 1, 2, 4, 8, and 16 respectively are not divided. Specifically, the subfields SF6 to SF12 are divided into two groups, and the remaining subfields SF1 to SF5 are not divided.

This is based on the reason that no big problem occurs even if the subfield with lower weighting may not be arranged completely symmetrically because the influence of shifting of weighting of light emission (from temporal viewpoint) is low. In this case, total number of the subfields is decreased by the number of those not divided, and it is advantageous in that the burden on the control system is alleviated.

In this case, the order of display in Group A is SF12*a*, SF10*a*, SF8*a*, SF6*a*, SF7*a*, SF9*a*, and SF11*a*, being arranged alternately in front and rear. On the other hand, the order of display in Group B is symmetrical to Group A, and the subfields are arranged in the order of SF11*b*, SF9*b*, SF7*b*, SF6*b*, SF8*b*, SF10*b*, and SF12*b*, being arranged alternatively in front and rear. The remaining subfields SF1 to SF5 are placed between Group A and Group B.

In the third embodiment of the invention, a weighted center of light emission can be set at the center of the field in all gradation levels regardless of whether it is a pixel with gradation level of "127" or a pixel of "128" as shown in FIG. 13. This makes it possible to prevent animated picture pseudo-contour perceived when animation image is displayed, and flicker disturbance generated at the boundary between different gradations and also to suppress pseudo-contour disturbance, which appears at the moment of blinking.

Also, the effects can be provided to alleviate the burden on the control system because total number of subfields is reduced as the subfields with lower weighting are not divided.

The reason why the subfields with lower weighting are not divided within one field is to avoid the increase of the burden in the driving speed. Thus, the number of the subfields to be divided should be adequately determined so that good balance is kept between the two types of effects, i.e. the effects of dividing to the burden on the control system and the effects to suppress pseudo-contour disturbance, flicker disturbance and animated picture pseudo-contour. In particular, when nematic liquid crystal is driven on subfields, the number of subfields to be divided within one field can be increased, and higher effects can be obtained.

In the third embodiment, subfields SF1 to SF5 are placed between Group A and Group B, while it is not limited to this position. These may be arranged to one of Group A and Group B or may be adequately dispersed to Group A and Group B. In the third embodiment, the subfields to be divided into the two groups are the subfields SF6 to SF12 each with weighting 32, but it may be designed in such manner that the subfields SF4 to SF12 with weighting of 8 or more may be divided into two groups by giving consideration on the burden to the control system or the balance on the effects.

Further, in the third embodiment, the subfields are arranged so that the weighting of the subfield is increased from the central portion toward outer side of the frame. However, this order may be reversed by allocating the subfields with lower weighting on outer side and the subfields with higher weighting on inner side. For instance, the order of the subfields in Group A in the third embodiment may be changed, and these may be allocated from outer side as: SF6*a*, SF8*a*, SF10*a*, SF12*a*, SF11*a*, SF9*a*, and SF7*a*. In this case, in group B, the subfields are arranged from inner side as: SF7*b*, SF9*b*, SF11*b*, SF12*b*, SF10*b*, SF8*b*, and SF6*b*.

In the embodiments as described above, the subfields are divided into two groups, i.e. Group A and Group B, while these may be divided into four groups. In this case, if it is supposed that the groups are divided as A, B, C and D in the order of the time elapsed, the subfields in the order of the arrangement in Group A and Group D are approximately symmetrical to each other and the subfields in Group B and Group C are approximately symmetrical to each other, and symmetry should be kept at least for each 2 groups. Naturally, these may be divided into 6 or more groups so far as the number of groups is set to even number. Also, the subfields divided into two groups may be mixed with the subfields divided into four groups. It is not that all of the subfields with higher relative ratios of luminance are divided, but even when some of the subfields with higher relative ratios of luminance are not divided, almost the same effects as in the embodiment described above can be obtained.

Specifically, if there are subfield groups where selected status and non-selected status are the same to each other and these are arranged symmetrically or almost symmetrically to each other around the center of the field in the order of the time elapsed, the weighting of light emission in the field may not be changed even when selection status of the subfields is changed due to gradation level.

Figure 23:
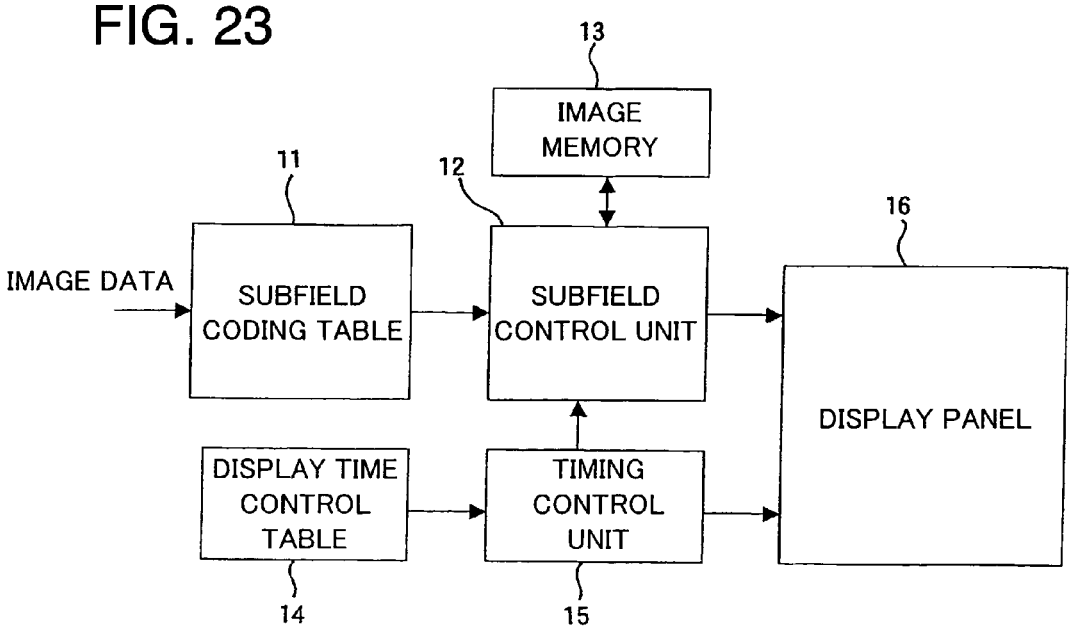
FIG. 23 is a block diagram showing an arrangement of a driving unit for carrying out the method for driving an image displaying apparatus, which was explained as the first embodiment of the present invention.

FIG. 23 is a block diagram showing an arrangement of a driving unit for carrying out the method for driving an image displaying apparatus, which was explained as the first embodiment of the present invention. In FIG. 23, an image data (an image signal) is added to a subfield coding table 11. In the subfield coding table 11, digitized image data is used as a reference data, and duration of one field is divided into a plurality of subfields. In the order of the subfields arranged according to a given sequence, a selection pattern data in parallel is called for each pixel, where it is turned to "1" if it is in lighting (selected) status and it is turned to "0" if it is in non-lighting (non-selected) status. Selection pattern data called in the subfield coding table 11 is stored in an image memory 13 by the subfield control unit 12. Further, based on a timing signal, the selection pattern data of the image memory 13 is called, and it is written to each pixel on a display panel 16. In this case, the image memory 13 has many storage areas, the number of the storage areas being obtained through multiplication of at least the number of pixels on the display panel 16 by the number of the divided subfields in the duration of one field with respect to the image data of one field. Preferably, the image memory has twice as many storage areas as those areas, which are obtained through multiplication of the number of pixels on the display panel 16 multiplied by the number of divided subfields for one field duration. After storing the selection pattern data called by the subfield coding table 11, the subfield control unit 12 sequentially reads out the subfield data at same order of all pixels and writes the data to the display panel 16. The display time control table 14 calls the time data with weighting of luminance of light emission of each subfield in the order of appearance of the subfield. The timing control unit 15 issues a timing signal to initiate data writing to the subfield control unit 12 at the initiation of the address time TA and adds a signal to control the lighting time to a driver (not shown) of the display panel 16 based on the time data called from the display time control table 14 with respect to the pixel where the number "1" is written by supposing that the end of the address time TA is the starting of the display time.

Now, description will be given on operation of the driving unit with the arrangement as described above. As already explained in the first embodiment, the subfields are arranged in two-crest arrangement where all subfields are divided into two groups, and it is supposed that the subfields are arranged symmetrically around the temporal center of the field. Also, it is supposed that the order of displaying when the subfields are numbered is: SF8*a*, SF6*a*, SF4*a*, SF2*a*, SF1*a*, SF3*a*, SF5*a*, SF7*a*, SF7*b*, SF5*b*, SF3*b*, SF1*b*, SF2*b*, SF4*b*, SF6*b*, and SF8*b*.

When the first pixel data of the image data is sent to the subfield coding table 11, a 16-bit selection pattern data in parallel is called from the subfield coding table 11 to match SF8*a*, SF6*a*, . . . , SF6*b* and SF8*b*. This selection pattern data is stored in the image memory 13 by the subfield control unit 12. The process of sending of pixel data, calling of the selection pattern data, and storage process are repeatedly performed for each pixel data for one field, and the selection pattern data for one field is stored in the image memory 13.

Next, the subfield control unit 12 reads out all of the data of SF8*a*, which is the first in the order of display among the selection pattern data of each pixel at the address time TA (e.g. corresponding to a gap between the subfields in FIG. 1), and writes it to each pixel on the display panel 16. When the writing has been completed, the timing control unit 15 refers to the display time control table 14, and a signal to light up the pixel where the number "1" has been written for the display time TD to match the weighting of SF8*a* (e.g. a signal to apply as many pulses as proportional to time) is added to the driver of the display panel 16. The time when the display time TD has elapsed is regarded as the beginning of the address time TA, and the timing control unit 15 issues a timing signal to write the data to the subfield control unit 12. The subfield control unit 12 reads out all of the data of SF6*a*, which is the second in the order of the display among the selection pattern data of each pixel, at the address time TA, and writes it to each pixel on the display panel 16. When this writing process has been completed, the timing control unit 15 refers to the display time control table 14 and adds a signal to light up the pixel where the number "1" has been written for the display time TD to match the weighting of SF6*a*. By repeating this procedure, the processes of reading of data from the image memory 13, writing of data to each pixel of the display panel 16, and applying of the lighting signal are repeatedly performed for SF4*a*, SF2*a*, . . . , SF6*b*, and SF8*b*. Thus, the processing of pixel data to be added to the subfield coding table 11 for one field is completed. During these processes, calling of the selection pattern data by the subfield coding table 11 to the next pixel data to be added to the subfield coding table 11, and storage of the data to another area of the image memory 13 are carried out.

Figure 24:
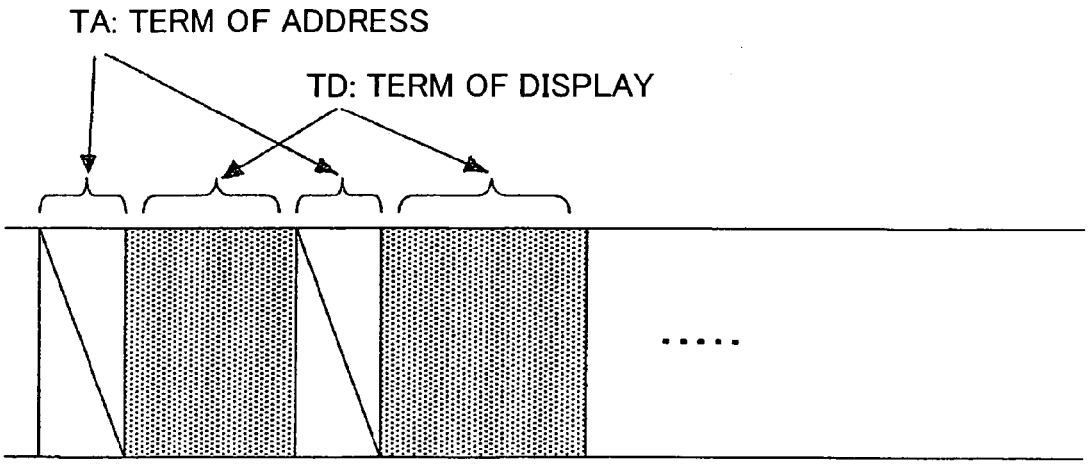
FIG. 24 is a time chart to show the relation between address time (term of address) TA when an image data is written to a display panel and display time (term of display) TD when pixel is lighted up.

FIG. 24 is a time chart to show the relation between the address time TA when the image data is written to the display panel 16 and the display time TD when the pixel with the number "1" is lighted up. The address time TA is constant and the display time TD is changed according to the weighting of the subfield.

As explained in the first embodiment, description has been given above on an example of arrangement and operation of the driving unit where subfields are arranged in two-crest arrangement where all of the subfields are divided into two groups, and the subfields are arranged symmetrically with respect to the center of the field. In the driving method based on the subfield pattern shown in FIG. 8 as explained in the second embodiment, and in the driving method based on the subfield pattern shown in FIG. 13 as explained in the third embodiment, the same driving control as described above can be accomplished by changing the subfield coding table 11 and the display time control table 14 to match the number of subfields and weighting.

In case the subfield groups are arranged symmetrically with respect to the temporal center of one field duration, only the selection pattern data for one group is written to the image memory 13 as the subfield coding table 11. It may be designed so that the same data may be read out again when the selection pattern data symmetrically arranged is called from the image memory 13 (i.e. if SF8*a* is read out without keeping SF8*b* data in memory, it would be all right because it is completely the same data). Similarly, it may be designed in such manner that the time data for one field is called as the display time control table 14, and by combining the time data symmetrical with the time data, the timing control unit 15 may generate each timing signal.

As described above, by arranging the driving unit of the image displaying apparatus as shown in FIG. 23, it is possible to carry out the method for driving the image displaying apparatus as shown in the first to the third embodiments.

The invention claimed is:

1. A method for driving an image displaying apparatus for expressing image signals of multiple gradations by dividing one field duration into a plurality of primary subfields with different gradation levels, said method comprising the steps of:

dividing each one of said primary subfields into "2n" secondary subfields whose gradation level weighting is equal to each other, where "n" is a natural number;

forming two secondary subfield groups so that each of said two secondary subfield groups includes a plurality of secondary subfields of different gradation level weightings in such a manner that "n" secondary subfields obtained by the division belong to each of said two secondary subfield groups; and arranging said secondary subfield groups symmetrically with respect to the center of one field duration, and symmetrically arranging said secondary subfields, whose gradation level weighting is equal to each other, with respect to the center of one field duration.

2. The method for driving an image displaying apparatus according to claim 1, wherein:

when it is supposed that the total number of the secondary subfields to be obtained by the division in one field is "m" and when the secondary subfields obtained by the division are numbered sequentially from the one with lower gradation in the order of: SF1, SF2, SF3, SF4, SF5, SF6 . . . , SFm-1, SFm;

one of the secondary subfield groups arranged symmetrically is arranged in such manner that the secondary subfield with lower gradation is positioned at the central portion, and the secondary subfields with higher gradation are arranged from the central portion to outer side alternately in front and rear in the order of: SFm-1 . . . , SF5, SF3, SF1, SF2, SF4, SF6 . . . , SFm, the other of the secondary subfield groups arranged symmetrically are arranged with the secondary subfields with lower gradation positioned at the central portion, and the secondary subfields with higher gradation are arranged alternately in front and rear from the central portion to outer side in the order of: SFm . . . , SF6, SF4, SF2, SF1, SF3, SF5, . . . , SFm-1.; and order of appearance of the secondary subfields in one of the secondary subfield groups and in the other of the secondary subfield groups arranged symmetrically is reversed.

3. The method for driving an image displaying apparatus according to claim 1, wherein:

when it is supposed that the total number of the secondary subfields to be obtained by the division in one field is "m" and when the secondary subfields obtained by the division are numbered sequentially from the one with lower gradation in the order of: SF1, SF2, SF3, SF4, SF5, SF6 . . . , SFm-1, and SFm;

one of the secondary subfield groups symmetrically arranged is arranged in such manner that the secondary subfields with lower gradation are positioned at outer side, and the secondary subfields with higher gradation are arranged from outer side to the central portion alternately in front and rear and the secondary subfields appear in the order to SF1, SF3, SF5 . . . , SFm-1, SFm . . . , SF6, SF4 and SF2;

the other of the secondary subfield groups arranged symmetrically are arranged with the secondary subfields with lower gradation positioned at outer side, and the secondary subfields with higher gradation are arranged alternately in front and rear from the outer side to the central portion, and the secondary subfields appear in the order of SF2, SF4, SF6, . . . , SFm, SFm-1, . . . , SF5, SF3, and SF1; and order of appearance of the secondary subfields in one of the secondary subfield groups and in the other of the secondary subfield groups arranged symmetrically is reversed.

* * * * *